US006367548B1

(12) United States Patent
Purvis et al.

(10) Patent No.: US 6,367,548 B1
(45) Date of Patent: Apr. 9, 2002

(54) DIVERSION TREATMENT METHOD

(75) Inventors: Donald L. Purvis, Parker; David D. Cramer, Littleton, both of CO (US); David D. Smith, Gillette, WY (US); Douglas L. Walton, Littleton, CO (US)

(73) Assignees: BJ Services Company; Ocean Energy Resources, Inc., both of Houston, TX (US)

( * ) Notice: Subject to any disclaimer, the term of this patent is extended or adjusted under 35 U.S.C. 154(b) by 0 days.

(21) Appl. No.: 09/519,064

(22) Filed: Mar. 3, 2000

Related U.S. Application Data

(60) Provisional application No. 60/123,104, filed on Mar. 5, 1999.

(51) Int. Cl.[7] ..... E21B 43/25

(52) U.S. Cl. ..... 166/281; 166/306; 166/307; 166/50

(58) Field of Search ..... 166/50, 271, 281, 166/305.1, 306, 307, 268

(56) References Cited

U.S. PATENT DOCUMENTS

| | | | | |
|---|---|---|---|---|
| 2,803,306 A | | 8/1957 | Hower | |
| 3,233,672 A | | 2/1966 | Carpenter | |
| 3,354,957 A | | 11/1967 | Every et al. | |
| 3,707,194 A | | 12/1972 | Svaldi | 166/305 |
| 3,719,228 A | * | 3/1973 | Garcia | |
| 3,756,319 A | * | 9/1973 | Holm et al. | |
| 3,859,107 A | * | 1/1975 | Garcia | |
| 3,948,324 A | | 4/1976 | Lybarger | 166/307 |
| 4,159,037 A | | 6/1979 | Varnon et al. | 166/269 |
| 4,232,741 A | | 11/1980 | Richardson et al. | 166/281 |
| 4,237,975 A | | 12/1980 | Scherubel | 166/281 |
| 4,444,264 A | | 4/1984 | Dill | 166/294 |
| 4,509,598 A | | 4/1985 | Earl et al. | 166/308 |
| 4,749,038 A | | 6/1988 | Shelley | 166/250 |
| 4,787,456 A | | 11/1988 | Jennings, Jr. et al. | 166/281 |
| 4,881,599 A | | 11/1989 | Franco et al. | 166/284 |

(List continued on next page.)

FOREIGN PATENT DOCUMENTS

EP 0 785 337 A3 8/1998

OTHER PUBLICATIONS

Purvis and Much, "Stimulation Proposal Jeffrey #33–33," BJ Services, Undated.
Dicussion, undated.
Well Data, undated.
Macid Design Model, Dec. 1997.
Threaded Tubing Option, Dec. 1998.
Coil Tubing Option, Feb. 1998.
Circa Coil Tubing Analysis, Feb. 1998.
Bullhead Diversion Option, Feb. 1998.
Materials Description, Feb. 1998.
Cost Estimate Summary, Feb. 1998.
Related Papers, Feb. 1998.
Nelson, "Foam Diversion in Matrix Acidizing Horizontal Open Hole Carbonates," SPE/CIM 6$^{th}$ One–Day Conference on Horizontal Well Technology, Calgary, Canada, pp. 1–10, Nov. 12, 1997.
Smith, "Conductivity Evaluation Using Divert X Followed by Xylene Upper Mission Canyon Formation Jeffery #33–33– Well," BJ Service Company Technology Center Report No. 98–02–0115, Mar. 5, 1998.
Treatment Report for Jeffery Well No. 33–33, May 29, 1998.

*Primary Examiner*—Roger Schoeppel
(74) *Attorney, Agent, or Firm*—O'Keefe, Egan & Peterman

(57) ABSTRACT

Methods and compositions for stimulating multiple intervals in wells by diverting well treatment fluids into multiple intervals by alternately displacing diverting agent from the annulus into a subterranean formation and displacing treatment fluid from a tubing string into the subterranean formation.

17 Claims, 4 Drawing Sheets

U.S. PATENT DOCUMENTS

Figure 1:
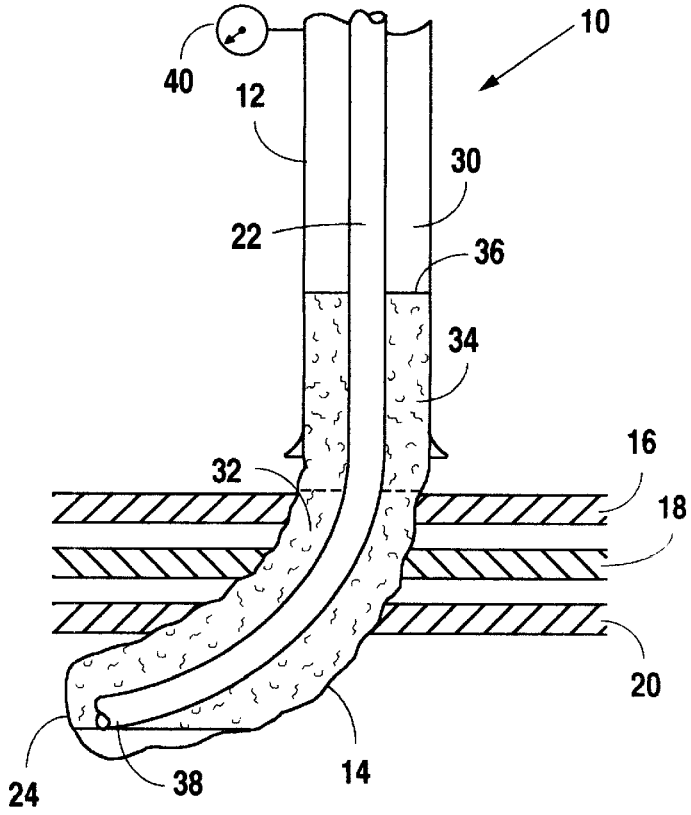

| | | | | |
|---|---|---|---|---|
| 4,887,670 | A | 12/1989 | Lord et al. | 166/281 |
| 4,917,185 | A | 4/1990 | Jennings, Jr. et al. | 166/281 |
| 5,018,578 | A | 5/1991 | El Rabaa et al. | 166/281 |
| 5,111,881 | A | 5/1992 | Soliman et al. | 166/250 |
| 5,113,942 | A | 5/1992 | McMechan | 166/250 |
| 5,159,979 | A | 11/1992 | Jennings, Jr. et al. | 166/280 |
| 5,203,413 | A | 4/1993 | Zerhboub | 166/281 |
| 5,238,067 | A | 8/1993 | Jennings, Jr. | 166/307 |
| 5,297,628 | A | 3/1994 | Jennings | 166/281 |
| 5,353,874 | A | 10/1994 | Manulik | 166/281 |
| 5,507,342 | A | 4/1996 | Copeland et al. | 166/279 |
| 5,813,463 | A | 9/1998 | Stadulis | 166/280 |
| 5,964,289 | A | 10/1999 | Hill | 166/250.1 |

* cited by examiner

DIVERSION TREATMENT METHOD

The present application claims priority on provisional U.S. patent application Ser. No. 60/123,104 filed on Mar. 5, 1999. The entire text and all contents of the above referenced disclosure is specifically incorporated by reference herein without disclaimer.

BACKGROUND OF THE INVENTION

1. Field of the Invention

This invention relates generally to methods and compositions for treating wells, and, more specifically to methods and compositions for stimulating multiple intervals in wells. In particular, this invention relates to methods and compositions for diverting well treatment fluids into multiple intervals by alternately displacing diverting agent from the annulus into a subterranean formation and displacing treatment fluid from a tubing string into the subterranean formation.

2. Description of Related Art

Well treatments, such as acid and fracture treatments of subterranean formations are routinely used to improve or stimulate the recovery of hydrocarbons. In many cases, a subterranean formation may include two or more intervals having varying permeability and/or injectivity. Some intervals may possess relatively low injectivity, or ability to accept injected fluids, due to relatively low permeability, high in-situ stress, and/or formation damage. Such intervals may be completed through preparations in a cased wellbore and/or may be completed open hole. In some cases, such formation intervals may be present in a highly deviated or horizontal section of a wellbore, for example, a lateral open hole section. In any case, when treating multiple intervals having variable injectivity it is often the case that most, if not all, of the introduced well treatment fluid will be displaced into one, or only a few, of the intervals having the highest injectivity.

In an effort to more evenly distribute displaced well treatment fluids into each of the multiple intervals being treated, methods and materials for diverting treatment fluids into intervals of lower permeability and/or injectivity have been developed. However, conventional diversion techniques may be costly and/or may achieve only limited success. In this regard, mechanical diversion techniques are typically complicated and costly. Furthermore, mechanical diversion methods are typically limited to cased hole environments and depend upon adequate cement and tool isolation for achieving diversion.

Alternatively, diversion agents such as polymers, suspended solid materials and/or foam have been employed when simultaneously treating multiple intervals of variable injectivity. Such diversion agents are typically pumped into a subterranean formation prior to a well treatment fluid in order to seal off intervals of higher permeability and divert the well treatment fluid to intervals of lower permeability. However, the diverting action of such diversion agents is often difficult to predict and monitor, and may not be successful in diverting treatment fluid into all desired intervals. These problems may be further aggravated in open hole completions, especially in highly deviated completions having large areas of a formation open to the wellbore. The presence of natural fractures may also make diversion more difficult.

SUMMARY OF THE INVENTION

Compositions and methods are provided for diverting well treatment fluids into multiple intervals of a subterranean formation having varying permeability and/or injectivity. The disclosed methods and compositions are suitable for use in vertical and horizontal wellbores, as well as for treating cased or open-hole completions in production or injection wells. Surprisingly, superior diversion of well treatment fluids into multiple intervals may be performed and monitored by utilizing both the tubing string and tubing/wellbore annulus as dual treating strings in combination with focused tubing placement during introduction of the treatment fluid.

Advantageously, by spotting a volume of diverting agent in the tubing/wellbore annulus across a desired treatment area of subterranean formation, the diversion agent may be squeezed or displaced into the desired treatment area of the subterranean formation prior to introduction of the treatment fluid through the tubing. Utilizing annular displacement of diversion agent into the formation in combination with displacement of well treatment fluid down the tubing allows focused placement of the treatment fluid by placing and repositioning the tubing in the wellbore, while at the same time monitoring the treating pressure to determine effectiveness of diversion. Advantageously, this allows real time modification of treating procedure in order to match the treatment to the response of the formation.

Further advantageously, maintaining a volume of diversion agent in the annulus above and adjacent to the formation being treated allows displacement of additional diversion agent into the formation when needed and almost instantaneously, without requiring displacement of a tubing volume of fluid.

In one embodiment, several intervals in the open hole section may be treated with the preferred acid formulation without communicating or interfering with other intervals. This procedure is designed to take advantage of dual treating strings, tubing placement, existing near wellbore blockage and a diverting agent, such as an oil soluble diverter system, to create a preferred flow path for a treatment such as an acid stimulation treatment. Examples of suitable diverting agents include, but are not to, those agents found in U.S. Pat. No. 2,803,306, which is incorporated herein by reference in its entirety. A static annular column facilitates real time analysis of down hole pressures. Confining the acid stimulation to a short interval tends to allow greater control of fracture dimensions or matrix penetration.

By combining the introduction of diversion agent stages from the annulus with well treatment fluid stages from the tubing, significant improvements in diversion may be obtained. In one embodiment, by starting a treatment with a tubing string positioned at the lowermost interval to be treated and by pulling the tubing string up the hole successively following diversion and treatment of multiple intervals, the probability of stimulating the most promising or desired intervals of a subterranean formation may be increased. Diverting agent suspended in, for example, a weighted brine is pumped down the annulus with acid pumped down the tubing or drill pipe. The end of tubing is first located at or below the identified stimulation candidate closest to the toe of the well. Diverting agent is pumped to plug leak off zones, natural and created fractures, etc. Treatment fluid such as acid is then pumped at a low rate to create a preferred flow path (or path of least resistance) by etching and worm-holing the formation of the target interval at the end of tubing. This preferred flow path is for the following treatment fluid that will typically be pumped at higher rates and pressures, possibly frac pressures if so desired. The rate is then increased and the fracture or matrix stimulation initiated following etching and worm-holing of the formation face. Tubing is then moved uphole to the next identified interval and the process repeated as many times as needed.

In one disclosed embodiment individual intervals of a subterranean formation may be stimulated with a treatment fluid (including, but not limited to, acid, gelled oil and water systems, solvent, surfactant systems, proppant-laden fluid systems, etc.) while greatly minimizing or eliminating communication and/or interference with other intervals. By utilizing the dual treating string combination of the annular space and tubing, and by focusing placement of the tubing in relation to the desired treating intervals, existing wellbore blockage and a neutrally buoyant diverter system may be employed to create a preferred flow path for the treatment fluid. Advantageously, maintaining a static annular column enables real time analysis of down hole pressures. Furthermore, confining a stimulation to a short interval allows greater control of fracture dimensions or matrix penetration, depending on the type of treatment performed. The disclosed method is particularly advantageous in stimulating high-angle or horizontal wellbores, such as the performance of acid stimulations on oil producing reservoirs, although it may be practiced in virtually any well configuration.

In one disclosed embodiment, the most promising stimulation intervals of a subterranean formation may be identified prior to treatment by, for example, any reservoir evaluations methods known in the art. A stimulation model (such as a matrix inflow or fracture propagation model) may be used to assist in determining an optimum fluid system, fluid properties, fluid volume and injection rate/rates to stimulate each interval. Treatment pressure may then be monitored by measuring the static annular column pressure during treatment, and compared to the pressure predicted by the stimulation model. Alternatively, optimal/predicted treatment pressure may be predicted using hand calculations and/or correlations. Advantageously, such a comparison allows modification of the treatment as required to optimize the treatment using for example, an algorithm disclosed herein.

In one respect, disclosed is a method of treating a wellbore penetrating a subterranean formation and having an inner pipe suspended within the wellbore, including the steps of: (A) introducing diverting agent into the pipe and displacing a volume of the diverting agent through the pipe into an annulus existing between the pipe and the wellbore to a point adjacent or above the subterranean formation; (B) introducing a fluid into the annulus and displacing at least a portion of the diverting agent volume present in the annulus into the subterranean formation; and (C) introducing a well treatment fluid into the pipe and displacing the well treatment fluid through the pipe and into the subterranean formation. The method may also include the steps of: (D) monitoring a surface treating pressure of the annulus or the pipe during the introducing of the well treatment fluid; (E) comparing the measured surface treating pressure, or a treating pressure value calculated based on the measured treating surface pressure, with a target surface treating pressure or target treating pressure value; and (F) ceasing introduction of the well treatment fluid into the pipe if the surface treating pressure or treating pressure value is substantially less than the respective target surface treating pressure or target treating pressure value, displacing an additional portion of the diverting agent volume present in the annulus into the subterranean formation, and then reestablishing introduction of the well treatment fluid into the pipe and displacing the well treatment fluid through the pipe and into the subterranean formation; or (G) continuing the introduction of the well treatment fluid into the pipe if the surface treating pressure or treating pressure value is substantially the same as the respective target surface treating pressure or target treating pressure value.

In one embodiment, the surface treating pressure may be annulus pressure or pipe (tubing, coil-tubing, etc.) pressure. A target surface pressure may be used for comparison, and based on a computer stimulation model, hand held calculation, correlation, or any other suitable dynamic wellbore pressure calculation method. A target treating pressure value includes any pressure value based on surface or bottom hole dynamic treating pressure which is proportional, or otherwise based on magnitude of surface or bottom hole treating pressure (e.g., such as a bottom hole treating pressure calculated based on surface tubing or annulus treating pressure). Advantageously then, any pressure parameter measured at the surface or downhole may be compared directly with a counterpart predicted or estimated pressure, or may be manipulated by calculation and compared to a relevant predicted or calculated value. In one exemplary embodiment, a target treating pressure or target treating pressure value may correspond to treatment conditions at which a formation is hydraulically fractured, or alternatively to an optimum matrix acidizing rate in a selected formation interval. It will be understood with benefit of this disclosure that any pressure treating value suitable for monitoring stimulation characteristics may be employed to achieve the benefits of the disclosed method.

The disclosed method may further include the steps of: (H) raising the pipe and measuring the force or weight required to raise the pipe during the introduction of the well treatment fluid if the surface treating pressure or treating pressure value is substantially greater than the respective target treating pressure or target treating pressure value, and comparing the measured force or weight to raise the pipe with a calculated or measured target weight or force required to raise the pipe in the absence of introduction of fluid into the pipe; and (I) ceasing introduction of the well treatment fluid into the pipe if the force or weight required to raise the pipe during the introduction of the well treatment fluid is substantially more than the target weight or force required to raise the pipe, and displacing an additional portion of the diverting agent volume present in the annulus into the subterranean formation, and then reestablishing introduction of the well treatment fluid into the pipe and displacing the well treatment fluid through the pipe and into the subterranean formation; or (J) continuing the introduction of the well treatment fluid into the pipe if the force or weight required to raise the pipe during the introduction of the well treatment fluid is not substantially more than target weight or force required to raise the pipe.

The method may further include repeating step (H), and then: (K) ceasing introduction of the well treatment fluid into the pipe if the force or weight required to raise the pipe during the introduction of the well treatment fluid is substantially more than the target weight or force required to raise the pipe, and (L) raising an end of the pipe above a point of suspected formation break down in the wellbore, and repeating one or more of the steps (A)–(L) as necessary; or continuing the introduction of the well treatment fluid into the pipe if the force or weight required to raise the pipe during the introduction of the well treatment fluid is substantially the same as the target weight or force required to raise the pipe.

Advantageously, in the disclosed method, the weight required to raise the tubing may be employed as a comparison value, or alternatively force or other weight-based variable may be measured and compared to a target value of like units that is based on a calculated or measured value to raise the pipe in the absence of introduction of the well treatment fluid into the pipe.

In another respect, disclosed is a method of treating at least two identified intervals of a subterranean formation penetrated by a highly deviated or horizontal wellbore having an inner pipe suspended within the wellbore, including: positioning an end of the pipe to a point below a first identified interval of the subterranean formation, the first interval being the identified interval located farthest from the surface; introducing diverting agent into the pipe and displacing a volume of the diverting agent through the pipe into an annulus existing between the pipe and the wellbore to a point adjacent or above the first interval of the subterranean formation; introducing a fluid into the annulus and displacing at least a portion of the diverting agent volume present in the annulus into the subterranean formation; introducing a well treatment fluid into the pipe and displacing the well treatment fluid through the pipe and into the first interval of the subterranean formation; repositioning the end of the pipe within the wellbore to a point adjacent or above at least a second identified interval of the subterranean formation, the second interval being located between the first interval and the surface; introducing a fluid into the annulus and displacing at least a portion of the diverting agent volume present in the annulus into the subterranean formation; introducing a well treatment fluid into the pipe and displacing the well treatment fluid through the pipe and into the second interval of the subterranean formation; and introducing a clean-up fluid into the subterranean formation, the clean-up fluid being effective to remove the diverting agent from the subterranean formation. The method may further include performing the following steps during the introduction of the well treatment fluid into the first and second intervals of the subterranean formation: (A) monitoring a surface treating pressure of the annulus or the pipe during the introducing of the well treatment fluid; (B) comparing the measured surface treating pressure, or a treating pressure value calculated based on the measured treating surface pressure, with a target surface treating pressure range or target treating pressure value range; and (C) ceasing introduction of the well treatment fluid into the pipe if the surface treating pressure or treating pressure value is substantially less than the respective target surface treating pressure range or target treating pressure value range, displacing an additional portion of the diverting agent volume present in the annulus into the subterranean formation, and then reestablishing introduction of the well treatment fluid into the pipe and displacing the well treatment fluid through the pipe and into the subterranean formation; or (D) continuing the introduction of the well treatment fluid into the pipe if the surface treating pressure or surface treating pressure value is substantially within the respective target surface treating pressure range or target treating pressure value range.

The method may further include: (E) raising the pipe and measuring the force or weight required to raise the pipe during the introduction of the well treatment fluid if the surface treating pressure or treating pressure value is substantially greater than the respective target surface treating pressure range or target treating pressure value range, and comparing the measured force or weight to raise the pipe with a target weight or target force based on the force required to raise the pipe in the absence of introduction of fluid into the pipe; and (F) ceasing introduction of the well treatment fluid into the pipe if the force or weight required to raise the pipe during the introduction of the well treatment fluid is substantially more than the target weight or target force, and displacing an additional portion of the diverting agent volume present in the annulus into the subterranean formation, and then reestablishing introduction of the well treatment fluid into the pipe and displacing the well treatment fluid through the pipe and into the subterranean formation; or (G) continuing the introduction of the well treatment fluid into the pipe if the force or weight required to raise the pipe during the introduction of the well treatment fluid is not substantially more than the target weight or target force.

The method may further include repeating the step (E), and then: (H) ceasing introduction of the well treatment fluid into the pipe if the force or weight required to raise the pipe during the introduction of the well treatment fluid is substantially more than the target weight or target force; and (I) raising an end of the pipe above a point of suspected formation break down in the wellbore, and repeating one or more of the steps (A)–(I) as necessary; or (J) continuing the introduction of the well treatment fluid into the pipe if the force or weight required to raise the pipe during the introduction of the well treatment fluid not substantially more that the target weight or target force.

In the practice of the disclosed method, ranges of target surface treating pressure or target treating pressure value may be determined based on wellbore, subterranean formation and/or well treatment parameters. With benefit of this disclosure these value ranges may be selected by those of skill in the art to represent values at which optimum treating or stimulation is occurring based on a comparison of the measured and predicted/calculated values. However, in one embodiment, a range of target surface treating pressure or target treating pressure value may be selected to range from about 5% less than to about 5% greater than (alternatively from about 10% less than to about 10% greater than, alternatively from about 15% less than to about 15% greater than, and further alternatively from about 20% less than to about 20% greater than) a calculated target treating pressure or treating pressure value that is estimated, predicted and/or calculated based on wellbore, formation and/or treatment fluid parameters using computer model, hand calculation, correlation, etc.

In the practice of the disclosed method, a target weight or target force required to raise a treating pipe (tubing, coil tubing, etc.) during introduction of a treatment fluid down the tubing may be with benefit of this disclosure by those of skill in the art to be any value indicative of increased frictional pressure in the pipe/casing annulus due to fluid traveling uphole toward a formation interval other than the desired stimulation interval. However, in one embodiment, a target weight or target force may be equal to about 10% greater than (alternatively about 15% greater than, alternatively about 20% greater than, further alternatively about 25% greater than) a calculated or measured value of weight or force required to raise the pipe in the absence of introduction of the well treatment fluid into the pipe (tubing, coil tubing, etc.). It will be understood with benefit of this disclosure either pressure or weight or force to lift the tubing may be monitored only, while still achieving the benefit of the disclosed method.

In another respect, disclosed is a method of treating a wellbore penetrating a subterranean formation and having an inner pipe suspended within the wellbore, including: (A) introducing diverting agent into the pipe and displacing a volume of the diverting agent through the pipe into an annulus existing between the pipe and the wellbore to a point adjacent or above the subterranean formation; (B) introducing a fluid into the annulus and displacing at least a portion of the diverting agent volume present in the annulus into the subterranean formation; and (C) introducing a well treatment fluid into the pipe and displacing the well treatment fluid through the pipe and into the subterranean formation; (D) monitoring a surface treating pressure of the annulus or the pipe during the introducing of the well treatment fluid and comparing the measured surface treating pressure, or a treating pressure value calculated based on the measured treating surface pressure, with a target surface treating pressure or target treating pressure value; and/or monitoring the force or weight required to raise the pipe during the introduction of the well treatment fluid and comparing the measured force or weight to raise the pipe with a calculated or measured target weight or force required to raise the pipe in the absence of introduction of fluid into the pipe; and modifying one or more of steps (A)–(C) based on at least one of the comparisons.

DESCRIPTION OF ILLUSTRATIVE EMBODIMENTS

In embodiments of the disclosed method, multiple intervals of a subterranean formation may be treated or stimulated in stages by successively introducing diverting agent into the formation from an annular space in the wellbore followed by introduction of well treatment fluid into the formation from an inner pipe positioned adjacent one of the intervals in the wellbore. As used herein, "wellbore" includes cased and/or open hole sections of a well, it being understood that a wellbore may be vertical, horizontal, or a combination thereof. The term "pipe string" refers to any conduit suitable for placement and transportation of fluids into a wellbore including, but not limited to, tubing, work string, drill pipe, coil tubing, etc. Furthermore, it will be understood with benefit of this disclosure that the disclosed diversion treatment and monitoring techniques are suitable for use with any type of well treatment fluid including, but not limited to, acid treatments, condensate treatments, hydraulic fracture treatments, etc. Furthermore, it will be understood that the benefits of the disclosed methods and compositions may be realized with well treatments performed below, at, or above a fracturing pressure of a formation.

FIG. 1 illustrates a well 10 having a vertical cased wellbore section 12 and a deviated open hole section 14. Exposed within open hole section 14 is a subterranean formation having multiple treatment intervals 16, 18 and 20. Although three separated intervals are illustrated in FIG. 1, it will be understood with benefit of this disclosure that anywhere from two treatment intervals up to any number of treatment intervals may be treated using the disclosed method and compositions. Furthermore, it will be understood that such treatment intervals may be contiguously disposed rather than separated by relatively impermeable areas such as shale breaks. Although FIG. 1 illustrates a partially cased wellbore having a deviated open hole section, it will also be understood that disclosed treatment methods may be utilized with virtually any type of wellbore completion scenario. For example, the disclosed method may advantageously be employed to treat well configurations including, but not limited to, vertical wellbores, fully cased wellbores, horizontal wellbores, wellbores having multiple laterals, and wellbores sharing one or more of these characteristics.

In FIG. 1, treatment intervals 16, 18 and 20 represent identified intervals of a subterranean formation that have been identified for treatment. In this regard, any number of intervals or only a portion thereof present in the subterranean formation may be so identified. Alternatively, such intervals may also represent perforated intervals in a cased wellbore. As shown in FIG. 1, a pipe string 22 has been positioned within well 20 so that the end of the pipe is placed toward the toe 24 of open hole section 14 and adjacent or below the base of the lowest identified treatment interval 20.

Although pipe string 22 may be any suitable conduit for conducting fluid into a well, in one embodiment flush joint tubing is employed in at least the open-hole section 14 to minimize the chance of sticking within wellbore sections 14 and/or 12. As shown in FIG. 1, a volume of diverting agent has been circulated down the pipe string 22 and up into the annulus space 30 from the end of the pipe string 38 to a point 36 above the uppermost identified interval 16 to be treated. It will be understood with benefit of this disclosure that any volume of diverting agent may be circulated and placed in the annulus including a volume less than that necessary to cover the identified intervals of the subterranean formation. However, in one embodiment, a sufficient volume 32 may be pumped to fill the annular interval exposed to the formation, with an additional volume to create a reserve volume 34 in the annulus 30 above the exposed interval. The reserve volume 34 may be equal to the volume 32 of the annular interval exposed formation. However, the reserved volume may also be eliminated or modified as desired, for example, based upon considerations not limited to the following criteria: presence of natural fracture systems, presence of high-leak off zone near the top of the interval to be treated, ratio of length of intervals to be treated versus intervals not treated, etc. If reserve volume 34 is consumed prior to stimulations of all identified intervals, it may be replaced by pumping additional diverting agent down pipe string 22 between stimulation stage volumes. Once at the end of tubing 38, it is circulated into annulus 22.

In the practice of disclosed method, any diverting agent or medium suitable for achieving diversion of fluids into the identified treatment intervals may be employed. In one embodiment, a neutrally buoyant diverting system may be employed, so as to reduce chance of segregation of the diverting agent and particulate diverting agent carrier fluid. Such segregation may result in, for example, accumulation of diverting agent at one or more locations in the wellbore and sticking of pipe string 22 within wellbore sections 12 and/or 14. Furthermore, segregation may result in loss of diversion action due to movement of the diverting agent away from the intervals to be treated. Neutrally buoyant diverting systems may be of particular advantage in highly deviated or horizontal wells, where gravity segregation of a non-neutrally buoyant diverting system may prevent efficient blockage or reduction in permeability of the entire circumference of formation face exposed in the wellbore due, for example, to migration of diverting agent upwards or downwards in the highly deviated or horizontal section of the wellbore.

Diverting agents which may be employed include any diverting agent (e.g., oil soluble, acid soluble, etc.) suitable for diverting subsequent treatment fluids into intervals having lower injectivity. Examples of suitable diverting agents include, but are not limited to, benzoic acid flakes, wax (such as "Divert VI" available from BJ Services), cement grade gilsonite or unitaite (such as "Divert X" available from BJ Services), polymers (including, but not limited to, natural polymers such as guar, or synthetic polymers such as polyacrylate), rock salt, etc. Other types of suitable diverters that may be employed include, but are not limited to, acid soluble diverters such as described in U.S. Pat. No. 3,353,874, and phtalimide particles as described in U.S. Pat. No. 4,444,264, both of which are incorporated herein by reference in their entirety.

A "neutrally buoyant" diverting system is a system in which a particulate diverting agent is suspended in a carrier fluid having sufficiently close density or specific gravities to result in a mixture in which solid components of the diverting agent do not substantially settle or rise in the system under static conditions. In one embodiment, cement grade gilsonite (such as "Divert X") may be mixed with about 8.9 pound per gallon ("ppg") brine to achieve a sufficiently neutrally buoyant diverting system. Any type of carrier fluid having a density suitable for forming neutrally buoyant diverter system may be employed including natural or synthetic brines (such as KCI water, etc.) and carrier fluids including gelling agents (such as normal or synthetic polymers) or other weighting materials known in the art. Cement grade gilsonite (also known as "Uintate") is a natural variety of asphalt that is crushed and sorted into multiple-size particles. This diverting agent composition may be blended at the well site with specific chemically-modified fresh water (water containing for example, about 0.05% to about 1% of a wetting surfactant) to disperse the gilsonite and optionally, a weighting agent (including but not limited to salts such as KCl, $NH_4Cl$, NaCl, $CaCl_2$, etc.) for density adjustment and/or formation-clay control, and a gelling agent (a polymer such as guar gum, hydroxy propylguar, carboxy methylhydroxy proprylguar, carboxy methyl hydroxyethyl cellulose, xanthan gum, carboxy methyl cellulose, etc.) for viscosity adjustment and/or drag reduction.

A diverting system may be displaced to the end of the tubing 38 and circulated into the annulus with the selected treatment fluid. In this regard, a treatment fluid may be any suitable treatment fluid known in the art including, but not limited to, acid (such as hydrochloric, hydrofluoric, acetic acid systems, etc.) gelled oil and water systems, solvent, surfactant systems, proppant-laden fluid systems, etc. Once placed in the annulus as shown in FIG. 1, the diverting system may be squeezed into the formation intervals 16, 18 and 20 by pumping fluid into the annulus 30 at the wellhead. In this regard, any fluid suitable for displacing annular fluid into the formation may be employed including, but not limited to, liquids (such as brine, fresh water, hydrocarbons, etc.) or gasses (such as nitrogen, $CO_2$, natural gas, etc.). When displacing diverting system into the formation, it may be desirable in some cases to keep the pump rate low (normally less than about 1 barrel per minute) to minimize friction pressure and prevent opening or fracturing of the formation. As permeable areas of the formation (pore throats, natural and created fractures and bugs, etc.) are plugged by diverting agent, annular pressure typically increases. Bottom hole pumping pressure may be monitored by measuring the surface annular pressure 40 and adjusting for hydrostatic head and frictional pumping pressures. In most cases, bottom hole pumping pressure should not be allowed to exceed formation fracturing pressure, so as to achieve optimum placement of diverting agent.

Following placement of the diverting agent, the selected well treatment fluid may then be pumped (typically at an initially low rate) down pipe string at 22 and into annular space 30. A low pumping rate may be employed so as to help create a preferred flow path of treatment fluid into lowermost identified treatment interval 20 by etching, wormholing or formation cleanup in areas of the formation adjacent end of tubing 38. This technique helps ensure selective treatment of the lower most interval. After a flow path is established the pump rate may be increased and a fracture or matrix stimulation treatment initiated. Bottom hole treating pressure ("BHTP") during stimulation may be monitored by measuring the static annular pressure 40 and adjusting for hydrostatic head. The calculated BHTP may be compared to pressure predicted by a matrix inflow or fracture propagation model as appropriate. The treatment procedure may then be modified as required based upon analysis of the BHTP (for example, by using the pressure annulus algorithm ("PAA")) attached as FIG. 3 and further described below.

Programs or models for modeling or predicting BHTP are known in the art and many are capable of modeling BHTP at both fracture and matrix rates. Examples of suitable models include, but are not limited to, "MACID" employed by "BJ SERVICES" and available from Meyer and Associates of Natrona Heights, Pennsylvania; "FRACPRO" from Resources Engineering Services; and "FRACPRO PT", available from Pinnacle Technology or San Francisco, Calif.

After the first identified interval is stimulated, in this case formation interval 20, pipe string 22 is moved up hole to place end of tubing 38 adjacent or immediately above the next identified interval 18. Remaining diverting system material 42 stored in annulus 30 may then be squeezed into the worm holes or fracture created in lower most interval 20 by the first well treatment stage by pumping fluid into the annulus 30 at the well head as before. Once again, BHTP may be monitored in a manner as described above and should be maintained below formation-fracturing pressure during pumping of the diverting agent. Following placement of the diverting agent, a second well treatment stage may be pumped down pipe string 22 to treat interval 18 as previously described. The process of selected stimulation treatment followed by moving pipe and pumping diverter down annulus 30 to divert flow from newly created fracture or worm-holes may be repeated until each of the identified intervals 16, 18 and 20 have been treated.

Figure 2:
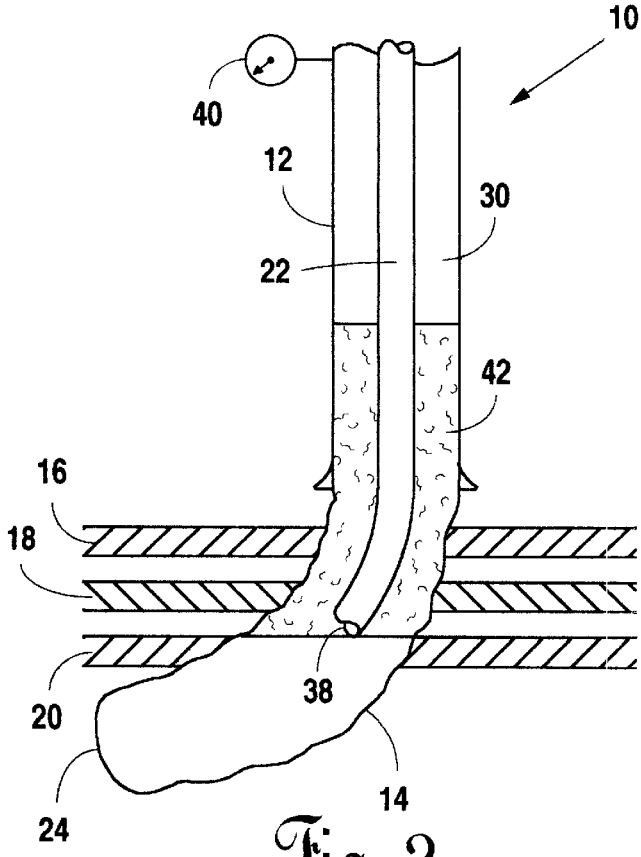

Following the treatment, fluid may then be circulated down the tubing 22 and up the annulus 30 to remove remaining diverting system 42 from the annulus 30. Pipe string 22 may be run into the hole to the toe 24 of the wellbore as this circulation is continued. In one embodiment, an optional cleanup system may then be squeezed into the treated formation intervals to dissolve diverting agent in the formation or fracture system. Such a cleanup system may be employed where diverting agent remains in the formation and it is desired to expedite its removal. The amount and type of cleanup fluid will depend on the diverting system and diverting agent employed. In the case of cement grade gilsonite (such as "DIVERT X"), xylene or other similar organic solvent or hydrocarbon may be squeezed into the formation to dissolve diverting agent in the formation. It is also possible to utilize lease crude and/or xylene to remove excess diverting agent 42 from annulus 30 as described in the previous step. In any case, a separate formation cleanup treatment may not be required, for example, where diverting agent will dissolve or deteriorate on its own. For example, because cement grade gilsonite dissolves upon contact with hydrocarbons, it tends to be removed as hydrocarbons are produced from the intervals (such as interval 16, 18 and 20 illustrated in FIG. 2). This may not be the case however in injection wells or other wells in which hydrocarbon production may not be encountered, but for which benefits of the disclosed treatment method may be realized. However, even in wells having hydrocarbon production, quicker and more complete diversion agent cleanup may be realized if a cleanup fluid treatment step is employed.

In the practice of one embodiment of the disclosed method, a stimulation treatment model appropriate for matrix and/or fracture pressure simulation may be performed to model a planned well treatment. Such models are well known in the art and in this regard, any such model suitable for predicting treatment bottom hole pressures may be employed. The data generated from such a model may be compared to bottom hole treating pressures during previously described well treatment phase of the disclosed method. In this regard, the modeled bottom hole pressures are typically compared to the bottom hole treating pressures obtained following the step of pumping an initial volume of well treatment fluid at a low rate to create a preferred flow path as described above. By monitoring the BHTP, and other parameters such as force required to reciprocate tubing, an indication of the success of diversion may be obtained.

Figure 3:
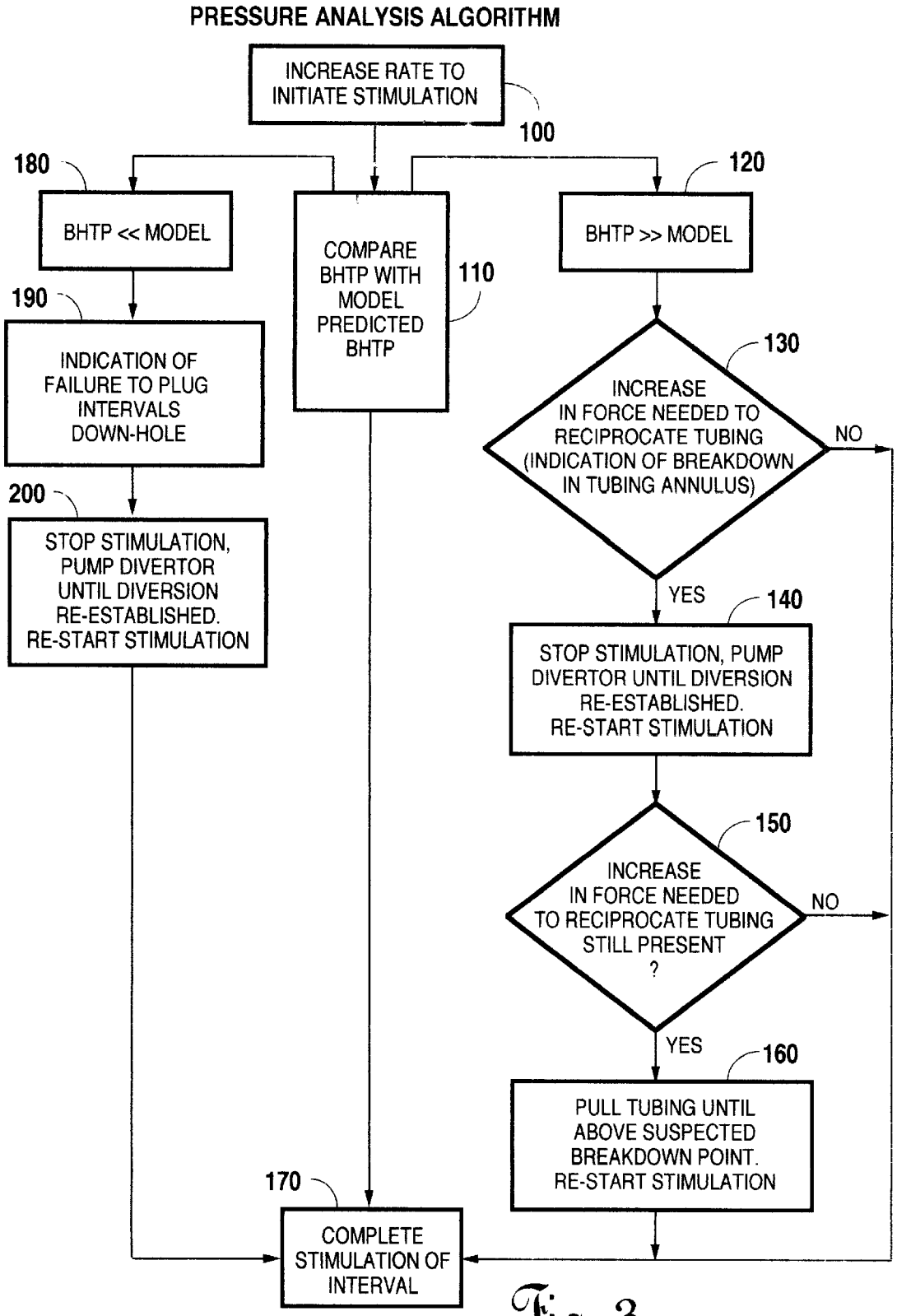

FIG. 3 illustrates a pressure analysis algorithm ("PAA") which may be employed in one embodiment of the disclosed method to monitor and modify a well treatment procedure during the performance of the treatment. As indicated in FIG. 3, the analysis is initiated following the step of displacing a diversion system into the formation and the step of establishing a worm hole or induced fracture with treatment fluid displaced down the pipe string 22. The PAA may be initiated and performed for one or more treatment stages of different treatment intervals. The PAA starts as shown in block 100 when treatment or stimulation rate is increased following establishment of a worm hole or fracture. As the rate is increased and during the displacement of the well treatment fluid, annular surface treating pressure and/or surface tubing treating pressure ("STP") may be used to calculate actual BHTP which is then compared with the predicted BHTP as previously described.

As indicated in block 120 of FIG. 3, should the actual BHTP be substantially greater than the model BHTP, a breakdown in the pipe string/open hole annular space 30 may be occurring at a point above the target treatment interval, indicating fluid entry may be occurring into a zone or formation located up the hole from the end of the tubing, rather in the desired formation of interest at or near the end of the tubing. In this case, and as indicated in block 130, the force needed to reciprocate the tubing (while pumping treatment fluid down the tubing) may be measured to check for an indication of such a breakdown in the pipe string/open hole annulus 30. In this regard, an increase in the amount of force required to reciprocate the tubing under dynamic fluid conditions (as compared to the force required under static conditions, i.e. without fluid being pumped down the tubing) is an indication of dynamic friction caused by movement of fluid through the tubing/casing annulus while pumping. If no over-normal increase force is required to reciprocate the tubing, stimulation of the interval may be continued as indicated in block 170. However, if additional force (as compared to normal pulling force) is required to reciprocate the tubing, this is a further indication that fluid is exiting the end of tubing and traveling up through the tubing/casing annulus to a zone or formation uphole from the zone of interest. Under this condition, stimulation may be stopped, additional diverter may be displaced into the formation by pumping into the annulus as previously described, and as indicated in Block 140. The treatment may be continued at this point (the preceding steps may be observed in the treatment report of Example 9, when treating the interval at 10,650 feet). After continuation of treatment, the force required to reciprocate the tubing may be checked again while pumping as indicated in block 150. If the additional force is no longer required the treatment may proceed to completion. However, as indicated in block 160, should additional force still be required to reciprocate the tubing, the tubing may be pulled above the suspected pipe string/open hole annulus breakdown point and the treatment reinitialized.

Still referring to FIG. 3, block 180 indicates that if the measured bottom-hole tubing pressure of block 110 is substantially less than the model-predicted bottom-hole tubing pressure for treatment of the interval in question, this may indicate a failure to plug the more permeable intervals or fractures in the subterranean formation, as shown in block 190. Accordingly, treatment should be stopped and additional diverter pumped until sufficient diversion is reestablished as indicated in block 200. Treatment may then be reestablished and completed. This may be observed in the treatment report of Example 9 when treating the interval at 10,050 feet. As indicated in block 110, should the actual bottom hole treating pressure ("BHTP") be within an acceptable range predicted by the model, a breakdown at or near the end of tubing is indicated and the treatment may be completed. This may be observed in the treatment report of Example 9 when treating the intervals at 10,450 and 9890 feet.

It will be understood with benefit of the present disclosure that FIG. 3 indicates one embodiment of the PAA that may be employed in the practice of the disclosed method. The disclosed method may be practiced using modifications and alterations of the PAA without departing from the scope of the method claimed herein. For example, should an increase in force be needed to reciprocate the tubing in block 130, it is possible to skip directly to block 160 without performing the steps of blocks 140 and 150. Furthermore, where an increase in force to reciprocate the tubing is still found present in block 150, it is possible to repeat block 140 and 150 (for a desired number of times) prior to going on to block 160 or 170. Other such alterations and modifications are possible.

In the practice of the disclosed method, annular and/or pipe string surface treatment pressure may be monitored utilizing any pressure monitoring equipment suitable for monitoring such pressures that is known in the art. It will be understood with benefit of the present disclosure that calculation of BHTP may be facilitated by maintaining a full column of liquid in the annulus. However, it is also understood that BHTP calculations based on fluid level analysis methods known in the art may also be employed. Furthermore, it will be understood that adequate sized surface and workover equipment should be employed to ensure that the pipe may be reciprocated during treatment without danger of exceeding pressure or weight limitations of the equipment.

Advantageously the disclosed method provides the advantages of eliminating the need for expensive and scarce large diameter coil tubing units, allowing placement of acids at intervals with the greatest potential for production, and provides effective diversion without long term formation damage.

EXAMPLES

The following examples are illustrative and should not be construed as limiting the scope of the invention or claims thereof.

Example 1

A subject well having a horizontal completion in the Nelson porosity of the Upper Mission Canyon formation was evaluated for treatment according to the disclosed method. The completion was in a low porosity interval (0.4%–10.1% porosity) with the permeability less than 1.12 md. Production in this interval was desired from natural vertical fractures which had been indicated in core samples. Acid stimulation was selected as the most promising method for introducing high conductivity channels to connect with the natural fracture mechanism. BJ Services' 3-dimensional acid frac model ("MACID") was utilized to model the treatment. The primary design criteria was to create a high conductivity path via small radial fractures while avoiding a conductive path into an adjacent formation known as the Midale. Table 1 gives reservoir data for the test well. Table 2 gives well configuration (including tubular geometry) for the completion. Table 3 illustrates calculated fluid volumes for the completion and Table 4 lists hydrostatic and frictional pressure calculations. In Table 4, "BHFP" represents the predicted bottom hole fracture pressure based on, for example, step rate test, model, or knowledge of formation fracture gradient. For matrix rate treatments, a bottom hole matrix treating pressure may be estimated using a model or correlation know in the art. A calculated STP at BHFP of 2230 psi is shown, based on consideration of hydrostatic pressure and pressure loss due to tubing friction.

TABLE 1

| Reservoir Data | |
|---|---|
| Pay Zone Height | 20 ft. |
| Vertical Depth To Top of Pay Zone | 9417 ft. |
| Fracture gradient | 0.65 psi/ft. |
| Bottom Hole Fracture Pressure | 6,120 psi |
| Bottom Hole Static Temperature | 225° F. |

TABLE 2

| Tubular Geometry | | | |
|---|---|---|---|
| | OD | ID | Depth |
| Tubing | 2 ⅜" | 1.995" | 9680'–10990' |
| Casing | 5 ½" | 4.892" | 9616' |
| Open Hole | | 4 ½" (nominal) | 11000' |

TABLE 3

| Volumes | |
|---|---|
| Initial Tubing Volume | |
| 0.0408*(ID)2*L | $0.0408*(1.995)^2*10990$ = 1785 gal (42.5 bbl) |
| Casing Annulus Volume | |
| 0.0408*(Casing $ID^2$ − Tubing $OD^2$)*L | $0.0408*(4.892^2 - 2.375^2)*9616$ = 7176 gal (171 bbl) |
| Open Hole Annulus Volume | |
| 0.0408*(Hole $dia^2$ − Tubing $OD^2$)*L | $0.0408*(4.5^2 - 2.375^2)*L$ = 0.59606 gal/ft<br>0.59605*1374 = 819 gal (19.5 bbl) |
| Open Hole Volume | |
| 0.0408*(Hole $dia^2$)*L | $0.0408*(4.5^2)*L$ = 0.826 gal/ft<br>0.826*1374' = 1135 gal (27 bbl) |

The 9616 foot to 11000 foot interval in the subject well was drilled horizontal. The interval was drilled at near balance to slightly underbalanced, with fresh water/nitrogen in a parasite string used to achieve underbalance. Production from the zone was believed to depend upon wellbore communication with natural fractures. However, the well exhibited poor initial production.

Figure 4:
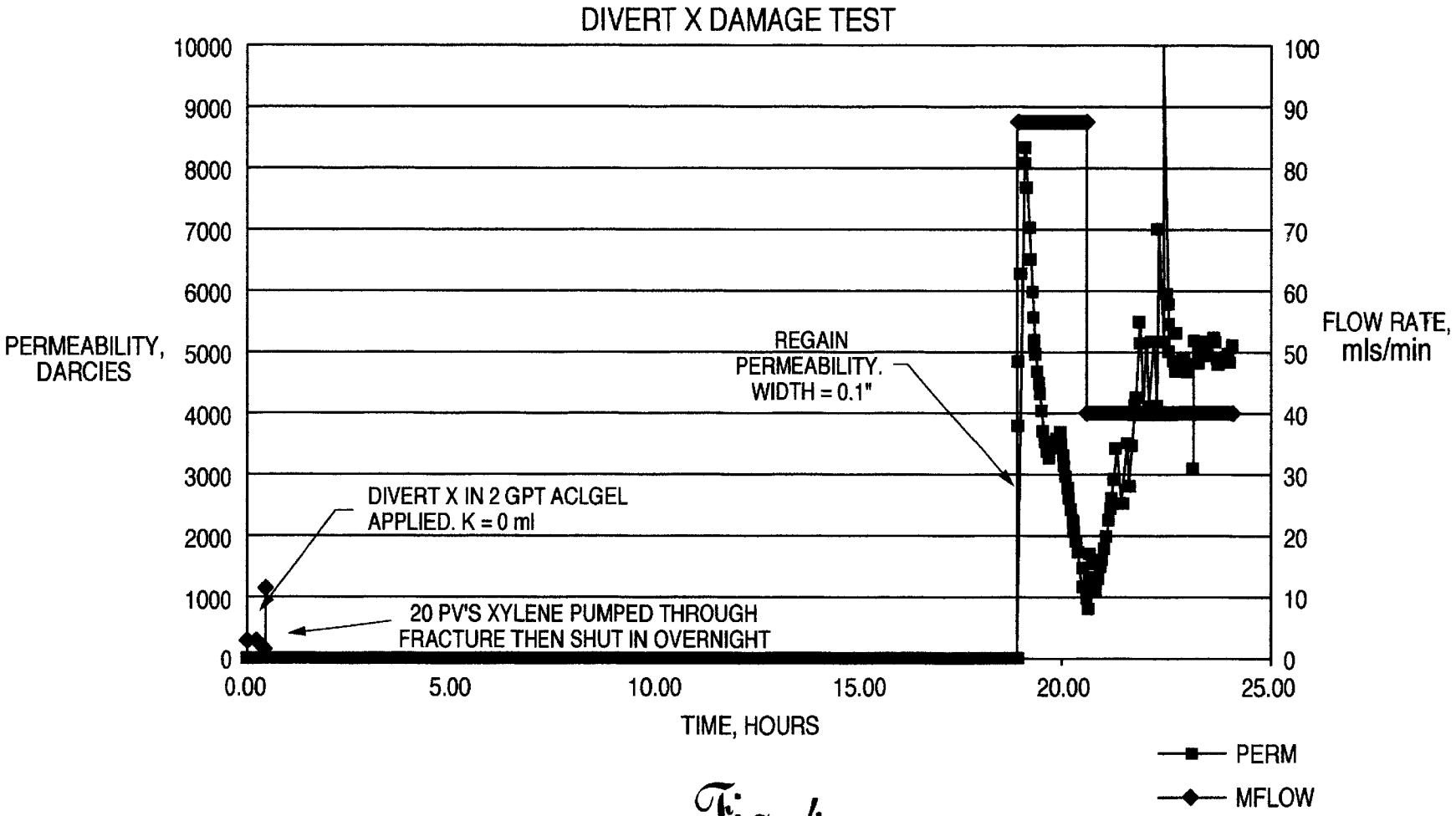

To evaluate the feasibility of diversion using Divert X, in the subject well, two equally sized slabs, approximately ¼ inch in thickness were prepared to fit a conductivity cell. Spacers, 0.1 inches in thickness, were utilized to simulate the projected fracture width. Divert X, blended in the gelled acid was first injected. Flow ceased. The Divert X successfully plugged the fracture. Xylene (20 pore volumes) was injected, and the system was shut in overnight. Flow was established with water until steady state was achieved. The test temperature was 225° F. Results are displayed in FIG. 4.

As may be seen, the Divert X completely plugged the fracture. Xylene effectively removed the Divert X and allowed production to be restored. The permeability was increased from 0 md to 5000 md, after the removal of the Divert X by xylene.

Table 14 is an alternate example which may be employed in a well similar to that of Example 1.

Example 2

Salt was mixed with fresh water to achieve the desired density necessary to create a diversion system having a neutral buoyancy. In this regard, 10 grams of Divert X was added to the salt to perform the test. 100 millimeters of water was chosen as the test volume so that a 100 milliliter glass cylinder could be used to observe the floating or sinking of the Divert X material. One gallon per 1,000 ("GPT") NE-18 nonemulsifier was added to reduce surface tension in the water. The tests were mixed and observed in the glass cylinders for 20 minutes duration. The dry Divert X material is about 22 millimeters of volume in a 100 millimeter cylinder. Table 5 represents the results of these tests.

TABLE 5

| Specific Gravity of Carrier Fluid | Divert X Floating, Milliliters of Material | Divert X Sinking, Milliliters of Material |
|---|---|---|
| 1,000 | 2 | 18 |
| 1.010 | 4 | 17 |
| 1.020 | 8 | 14 |
| 1.030 | 10 | 12 |
| 1,040 | 10 | 10 |

TABLE 5-continued

| Specific Gravity of Carrier Fluid | Divert X Floating, Milliliters of Material | Divert X Sinking, Milliliters of Material |
|---|---|---|
| 1.050 | 20 | 2 |
| 1.060 | 22 | 0 |

Figure 5:
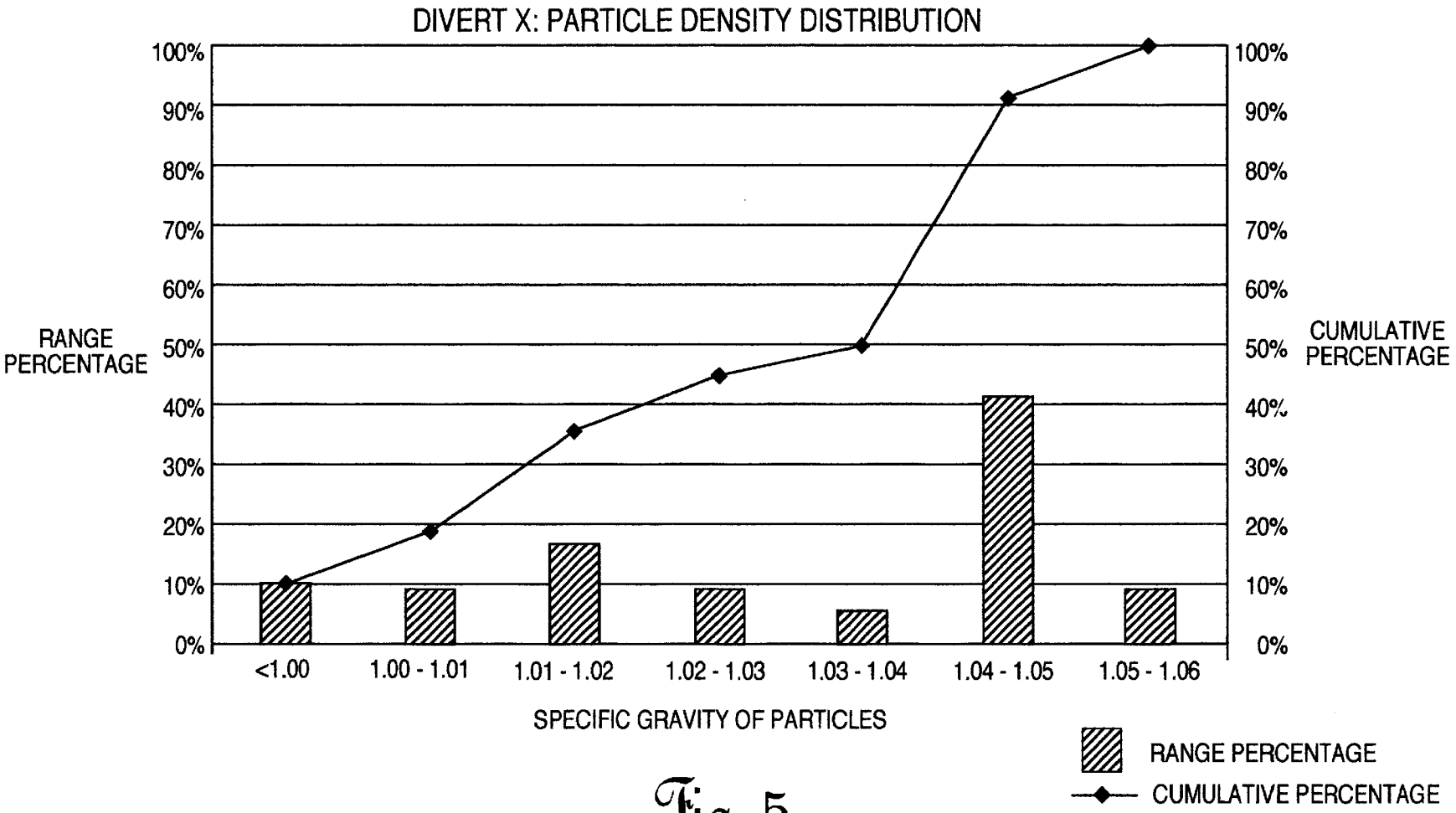

Based on the above, the Divert X material did not all float or sink, indicating that the density may vary within the material sample. Suspension of the material seemed to be best in the 1.020–1.040 specific gravity ranges. FIG. 5 illustrates the particle density distribution for Divert X cement grade gilsonite.

Example 3

Table 7 lists components of an acid well treatment fluid and diversion pad for the disclosed method.

Example 4

Exemplary Treatment Embodiment

Prior to treatment, the most promising open hole stimulation intervals are identified. A three-dimensional matrix or fracturing model is used to determine the optimum acid system, rheology, volume and rates to stimulate each interval. The acid system will vary depending temperature, formation properties and pipe contact time.

Flush joint tubing and/or drillpipe is first run in the hole. A length sufficient to cover the open hole section with extension into the vertical hole should be used. The use of flush joint tubing in the open hole is done to minimize the force required to move pipe. Conventional drill-pipe or tubing may be used in the vertical cased hole above the flush joint pipe.

Tubing is run in hole until the end of tubing ("EOT") reaches the open hole section. An optional check vale may then be placed in line in the tubing string to isolate bottom hole tubing pressure from the surface when making connections. Conventional tubing is connected above the check valve and the tubing run to the identified treatment interval closest to the end of the hole.

Cement grade gilsonite (such as Divert X) is suspended in gelled brine to form a Divertor System, and then circulated down the tubing and across the intervals to be treated with additional reserve volume circulated above the uppermost interval. The brine may be adjusted to match the absolute density of gilsonite. In one embodiment Gilsonite concentrations may vary between 0.5 and 1.5 pounds added per gallon of brine depending on the formation properties.

The Divertor System may be displaced with treatment fluid down the tubing. Pumping should stop prior to the acid reach EOT. Continual pipe reciprocation may be utilized to minimize the potential for sticking the tubing.

Fluid may then be pumped down the annulus to force the Divertor System into the formation to screen off natural fractures. A successful squeeze will be indicated by an increase in annulus pressure. The pressure should not be allowed to exceed fracture initiation pressure.

A small amount of acid is then pumped down the tubing at matrix rates to create etching and worm holing in the interval closest to the end of tubing. This tends to create a preferential path of least resistance for the acid treatment. The interval is then stimulated as per the design model.

Next, the tubing is pulled up to the next identified treatment interval. Existing fractures and/or worm holes in the first treated interval below the tubing is sealed off by pumping fluid down the annulus to displace diversion system. The stimulation process is then repeated.

After stimulating all identified intervals in the open hole, the tubing is pulled until the check valve may be removed. Lease crude is then circulated down the tubing to remove Divert X from the annulus. Circulation with lease crude is continued as tubing is run to the toe. If needed, Xylene may be used to rapidly dissolve the Divert X. Once at the toe, Xylene is squeezed into the formation to dissolve Divert X in the fracture system. As the well produces oil, any remaining Divert X will dissolve, further increasing production.

Listed below are descriptions of materials which may be useful in the practice of the disclosed treatment method. With benefit of this disclosure, these and other similar materials known in the art may be utilized by those of skill in the art to perform stimulation treatments according to the disclosed method.

Benzoic Acid

Benzoic Acid is a temporary diverting agent used in acidizing stimulation treatments in sandstone and carbonate reservoirs. Although soluble in both hydrocarbon and water-based fluids, the rate of solubility is sufficiently low to allow mixing and pumping with both fluids. Benzoic acid is effective in diverting treatments in both open hole and cased wells and is stable at temperatures up to at least about 350° F. (177° C.). Stable to 300° F. (149° C.). Cooldown effects allow usage in wells with bottomhole temperatures over about 400° F. (204° C.). Effective at concentrations, for example, of from about 0.25 to 2.0 ppg (29.95 to 239.6 kg/m$^3$).

Divert VI

Divert VI is an oil-soluble, water-insoluble temporary bridging agent which may be used to divert treating fluids during stimulation treatments. Its strength, combined with deformability may be used to provide effective sealing of natural fractures and intergranular pores to permit uniform distribution of the treating fluid over the entire producing interval. Divert IV may be used in all water-based fracturing fluids, including acid, for leakoff control in natural fractures. It also is an effective diverter for matrix acidizing applications. In one embodiment, it may be used at concentrations from about 0.25 to about 2 ppg (30 to 240 kg/m$^3$). Particles range in size from 0.05 to 0.375 in. (0.13 to 0.95 cm) in diameter. Particles have a narrow melting point range of about 150° F. to about 160° F. Insoluble in water-based solutions and readily soluble in hydrocarbon fluids. Can be used in all water-based treatments. Compatible with the environment.

Divert X

Divert X is an oil-soluble, solid diverting agent. This black solid material has a specific gravity of about 1.03 that mixes easily and disperses evenly in acid and water-based fluids. Specific gravity of 1.03 gives Divert X a near-neutral buoyancy. Stable to at least about 330° F. (166° C.) for deep, hot applications. Soluble in paraffinic solvents, xylene and crude oil.

Rock Salt

Graded and sized rock salt may be used as diverter for multiple zone completions. Range of particle size in one exemplary embodiment is from about 0.002" to about 0.25". In one exemplary embodiment, concentrations in perforated intervals may be about 0.5 to about 4 lbs/gallon. In another exemplary embodiment for open hole well sections, about 10 to about 25 lbs per foot of zone may be used.

Example 6

Additional Exemplary Information

In some embodiments of the disclosed method it may be desirable to install a check valve in the pipe string to isolate bottom hole tubing pressure from the surface when making connections. For example, when the pipe string is run in the hole it may be desirable to install such a check valve when the end of tubing reaches the open hole section 14 of a completion such as that shown in FIGS. 1 and 2. In another embodiment, conventional flush joint tubing may be run to the toe 24 of the open hole section 14 of a wellbore such as that illustrated in FIGS. 1 and 2. A flow control valve in the bypass position may be connected to the top of the flush joint tubing at this time. A flow control valve is then set by dropping a bar to prevent high density acid from "U-tubing" or flowing into the formation. Two floats may then be installed on top of the tubing string to allow connections to be made without bleeding pressure or waiting for the pressure to decline after each stimulation. A suitable flow control valve would include one such as a Baker Model "C" injection control valve available from Baker Oil Tools.

In those embodiments utilizing a blowout preventor such as the RPM System 3,000, conventional threaded tubing may be used. Also suitable is a blowout preventor available from Alpine Drilling which will withstand approximately 3,000 psi while shut in and 2,000 psi while moving pipe. For one exemplary well treatment design, maximum pressure in the annulus based on BJ Services "MACID" simulation was estimated to be approximately 1950 psi. Flush joint tubing, for example run on the lower 1,500 feet of a tubing string will reduce the potential for bridging and pinning the tubing. A low concentration of Divert X in the gel brine as well as neutral buoyancy of the diversion system further reduces this risk. A fluid control valve installed in the bottom of the tubing string is used to prevent losing fluid to the formation between stimulation treatments. A float with backup should be installed approximately 9600 feet from the end of the tubing to prevent divertor system from flowing back into the tubing and to allow tubing connections without having to wait for down hole pressure to dissipate. Surface equipment suitable for allowing movement of the tubing during the disclosed treating method include, for example, a "RPM System 3,000" rotating blowout preventor available from Tech Corp. Industries, Inc. Such a blowout preventor is designed to maintain back pressure on the wellbore during a drilling operation while rotating and designed to seal on both smooth pipe or irregular kellys.

Example 7

Summary of Four Treatments

Four treatments are summarized as follows. Based on the treating and static pressure data, multiple intervals were fractured or existing natural fractures were stimulated. Fourfold increase in 30-day Oil, and ten-fold gas production increases have been observed.

Example 8

Treatment of a Two-Lateral Well

Below is given well information for treatment of two laterals of a single well. In the treatment documented, as "Treatment A", (Tables 6–9) the second leg of the well was treated by circulating diverting agent down the tubing and into the annulus as described above. In the treatment documented as "Treatment B", (Tables 10–13) an alternate embodiment in which diverting agent is circulated to bottom through the annulus is described.

Exemplary materials that may be used in treating are listed as follows:

ACIGEL (Gelling Agent/Friction Reducer)

A high temperature (up to 325 Degrees Fahrenheit) stable gelling agent for 5% to 28% HCL, mud acid, HCL/acetic acid and HCL/formic acid blends. Acigel also provides excellent friction reduction in both acids and water-base fluids.

ADOMALL (Bactericide)

A cationic bactericide in a convenient liquid used in water-based fracturing fluids.

CI-25 (Corrosion Inhibitor)

An inhibitor for use in hydrochloric acid and in formulations which combine hydrochloric with other acids, such as acetic, formic or hydrofluoric. It provides effective protection of tubulars and downhole equipment in bottomhole temperatures up to 250 deg Fahrenheit (121 deg C.), and with the use Hy-Temp intensifiers it can provide protection at temperatures in excess of 325 deg F.(163 deg C.).

FERROTROL (Iron Control)

Used primarily in acidic stimulation treatment fluids to prevent precipitation of ferric hydroxide [Fe(III)] as the pH of the fluid rises upon spending.

HYDROCHLORIC ACID (Inorganic Acid)

An inorganic acid (HCL) used in primary acidizing of carbonate and sandstone formations. It is the most common of oil field acids. It is typically used in concentrations from 3% to 28%, (by weight). Higher concentrations are avoided due to increased volumes of inhibitors required and quantities of fines generated as the acid spends on the formation rock.

NE-110 (Surfactant)

An anionic surfactant used in both oil and aqueous solutions to break crude oil emulsions and water blocks.

NE-118 (Non-Emulsifier)

A non-ionic surfactant system designed for use in acid water based stimulation fluids to prevent the emulsification of reservoir fluids. This product is for use in either sandstone or carbonate formations.

NE-13 (Non-Emulsifier)

A blend of cationic surface active agents used as a non-emulsifier and anti-sludging agent in acid stimulation treatments. It prevents emulsion in acids and allows spent acid to return more readily.

NE-22 (Non-Emulsifier)

A blend of cationic surface-active agents used as a non-emulsifier and surface tension reducer in stimulation treatments of-carbonate formations.

FAW-21

A multi-purpose amphoteric foamer used for acids, and brines. Compatible with most additives and can be used in the presence of 10% methanol, or 5% US-2.

Treatment A

TABLE 6

| | | |
|---|---|---|
| Surface Treating Pressure (max) | | 4,097 psi |
| Total Rate (max) | | 5.00 bmp |
| Estimated Pump time (HH:MM) | | 7:15 |
| Flush | 21,000 gals | 8.7 ppg Brine Pad/Flush |
| Acid Frac | 35,000 gals | 15% Gelled Acid |
| Solvent | 1,600 gals | Xylene |

TABLE 7

| | |
|---|---|
| Formation | Bluell |
| Formation Type | Limestone |
| Pay Zone Height | 800 ft. |
| MD Depth to Middle Perforation | 10,335 ft. |
| TVD Depth to Middle Perforation | 9,692 ft. |
| Fracture Gradient | 0.65 psi/ft. |
| Bottom Hole Fracture Pressure | 6,299 psi |
| Bottom Hole Static Temperature | 225° F. |

TABLE 7-continued

| Perforated Interval | | | | |
|---|---|---|---|---|
| Depth | | | | |
| MEASURED | TRUE VERTICAL | Shots per foot | Perf Diameter (in) | Total Perfs |
| 9,935–10,735 | 9,690–9,693 | 50 | 1.00 | 150 |

| | |
|---|---|
| Total Number of Perforations | 150 |
| Total Feet Perforated | 800 ft. |

| Tabular Geometry | | | | Top | Bottom |
|---|---|---|---|---|---|
| Open Hole | 4½" OD | | | 9,935 | 10,735 |
| Tubing | 2⅞" OD | (2,441" ID) | 6.5# | 0 | 9,000 |
| Tubing | 2⅜" OD | (1.995" ID) | 4.6# | 9,000 | 10,735 |
| Casing | 5½" OD | (4.892" ID) | 17# | 0 | 9,935 |

| | |
|---|---|
| End of Tubing | 10,735 ft. |
| Pump Via | Tubing |

TABLE 8

| FLUID SPECIFICATIONS | | |
|---|---|---|
| Flush: 8.7 ppg Brine Pad/Flush | | |
| 21,000 Gallons | | |
| Components: | | |
| 2 gpt. | Acigel | Gelling Agent |
| 1 gpt. | NE-118 | Non-Emulsifier |
| Acid Frac: 15% Gelled Acid | | |
| 35,000 Gallons | | |
| Components: | | |
| 10 gpt. | Acigel | Gelling Agent |
| 5 gpt. | CI-25 | Corrosion Inhibitor |
| 5 gpt. | Ferrotrol-800LIron | Control Product |
| 2 gpt. | FAW-21 | Foaming Agent |
| 2 gpt. | NE-13 | Non-Emulsifier |
| Solvent: Xylene | | |
| 1,600 Gallons | | |
| Components: | | |
| 12 gals | NE-110 | Non-Emulsifier |

TABLE 9

| | STP | Annulus | Stage | Total | | |
|---|---|---|---|---|---|---|
| 5:00 | 0 | 0 | | 0 | 0 | Arrive on Location |
| 8:12 | 0 | 0 | | 0 | 0 | Safety Meeting |
| 6:30 | 0 | 0 | 0 | 0 | 0 | READY TO SERVICE |
| 8:18 | 4976 | 0 | 0 | 0 | 0 | PRESSURE TEST |
| 8:21 | 0 | 0 | 0 | 0 | 3.5 | START PUMPING FLUSH |
| 8:23 | 243 | 0 | 6 | 0 | 1.7 | CATCH FLUID |
| 8:24 | 2230 | 2112 | 6 | 6 | 0 | SHUT DOWN |
| 9:26 | 40 | 40 | 0 | 12 | 3 | START DIVERT DOWN TUBING |
| 9:29 | 800 | 110 | 10 | 12 | 3 | Start acid @ 10650 |
| 9:47 | 0 | 166 | 60 | 22 | 1.1 | ACID @ EOT SHUT IN ANNULUS |
| 9:52 | 856 | 1383 | 5 | 82 | 3 | INCREASE IN PSI |
| 9:55 | 1895 | 1520 | 15 | 87 | 6.89 | INCREASE IN PSI |
| 10:04 | 1924 | 1481 | 60 | 102 | 7.05 | RATE & PSI |
| 10:10 | 1943 | 1500 | 40 | 162 | 7.05 | PUMP DOWN ANNULUS |
| 10:12 | 2060 | 1500 | 30 | 202 | 7.03 | START ACID |
| 10:16 | 2119 | 1491 | 20 | 232 | 7 | START FLUSH |
| 10:18 | 0 | 1413 | 10 | 252 | 0 | SHUT DOWN MOVE TUBING TO 10450 |
| 10:34 | 515 | 692 | 0 | 262 | 2.84 | START ACID @ 10450 |
| 10:46 | 408 | 1003 | 30 | 262 | 0 | SHUT DOWN ACID @ EOT PUMP DOWN ANNULUS |
| 10:53 | 29 | 1140 | 10 | 292 | 3 | SHUT DOWN ANNULUS START ACID DOWN TUBING |
| 10:56 | 1613 | 1081 | 4 | 302 | 7.03 | RATE & PSI |
| 11:01 | 1846 | 1403 | 40 | 306 | 7.09 | BREAK IN PSI ON TUBING (BROKE @ 2316 PSI) |
| 11:09 | 1953 | 1481 | 56 | 348 | 7.07 | PUMP DOWN ANNULUS |
| 11:18 | 2218 | 1491 | 60 | 402 | 0 | SHUT DOWN PUMPED 50 DIVERT AND 10 WATER |
| | | | | 462 | | JOB SUBTOTAL PUMPED |
| 11:40 | 39 | 653 | 0 | 462 | 1.6 | START ACID DOWN TUBING @ 10050 |
| 12:04 | 693 | 877 | 46 | 462 | 2.7 | INCREASE RATE |
| 12:09 | 719 | 994 | 14 | 508 | 3.17 | ACID @ EOT |
| 12:11 | 1254 | 1082 | 5 | 522 | 7.13 | INCREASE RATE |
| 12:15 | 1769 | 1325 | 30 | 527 | 7.08 | SLOW STEADY INCREASE IN PSI ON BOTH SIDES |
| 12:31 | 1944 | 1471 | 105 | 557 | 7.03 | Psi & rate stable |
| 12:48 | 1944 | 1471 | 130 | 662 | 7.02 | START DIVERT |
| 12:54 | 1798 | 1452 | 40 | 792 | 6.57 | START WATER |
| 12:57 | 1885 | 1442 | 10 | 832 | 0 | SHUT DOWN PSI ON TUBING WENT TO 389 PSI ANNULUS @ 1344 |
| | | | | 842 | | DEPTH @ 9890 PUMP ALL REMAINING DIVERT AND ALL REMAINING ACID |
| 13:10 | 0 | 1003 | 0 | 842 | 3 | START DIVERT (DIVERT @ EOT) |
| 13:29 | 962 | 1091 | 52 | 842 | 3 | START ACID DOWN TUBING @ 9890 |
| 13:37 | 1137 | 1169 | 23 | 894 | 3.5 | RATE & PSI |
| 13:39 | 1147 | 1198 | 9 | 917 | 4 | INCREASE RATE |
| 13:44 | 1301 | 1325 | 19 | 926 | 4.34 | ACID @ EOT |
| 13:51 | 1295 | 1354 | 30 | 945 | 3.98 | DECREASE RATE |

TABLE 9-continued

| | STP | Annulus | Stage | Total | | |
|---|---|---|---|---|---|---|
| 14:01 | 1205 | 1335 | 45 | 975 | 3.97 | RATE & PSI |
| 14:16 | 1137 | 1315 | 61 | 1020 | 3.35 | START CRUDE |
| 14:30 | 1759 | 1305 | 45 | 1081 | 2.79 | START WATER |
| 14:33 | 1837 | 1296 | 5 | 1126 | 0 | SHUT DOWN (RIH TO 10650) |
| 15:21 | 39 | 750 | 0 | 1131 | 1 | PUMP DOWN ANNULUS WITH OIL |
| 15:34 | 39 | 896 | 15 | 1131 | 1.2 | START WATER |
| 15:39 | 39 | 896 | 5 | 1148 | 0 | SHUT DOWN |
| 16:30 | 58 | 156 | 0 | 1151 | 4.5 | SPOT XYLENE DOWN TUBING |
| 16:48 | 1127 | 146 | 40 | 1151 | 2.52 | START OIL |
| 16:57 | 1331 | 302 | 21 | 1191 | 2.89 | XYLENE @ EOT |
| 17:00 | 1283 | 380 | 16 | 1212 | 2.57 | START WATER |
| 17:11 | 1302 | 546 | 19 | 1226 | 0 | SHUT DOWN XYLENE ON SPOT |
| | | | | 1247 | | |
| | | | | 1247 | | |
| | | | | 1247 | | |
| | | | | 1247 | | PUMPED A TOTAL OF 842 BBL ACID, 429 BBL WATER AND DIVERT |
| | | | | 1247 | | AND 81 BBL OF OIL |
| | | | | 1247 | | TOTAL DIVERT PUMPED WAS 210 BBL @ 0.75 PPG |

Treatment B

TABLE 10

| | | | |
|---|---|---|---|
| Surface Treating Pressure (max) | | 4,097 | psi |
| Total Rate (max) | | 5.00 | bmp |
| Estimated Pump Time (HH:MM) | | 7:15 | |
| Flush | 35,000 gals | 8.7 | ppg Brine Pad/Flush |
| Acid Frac | 60,000 gals | 15% | Gelled Acid |
| Solvent | 2,700 gals | Xylene | |

TABLE 11

| Reservoir Data | |
|---|---|
| Formation | Bluell |
| Formation Type | Limestone |
| Pay Zone Height | 1,199 ft. |
| MD Depth to Middle Perforation | 10,485 ft. |
| TVD Depth to Middle Perforation | 9,692 ft. |
| Fracture Gradient | 0.65 psi/ft. |
| Bottom Hole Fracture Pressure | 6,299 psi |
| Bottom Hole Static Temperature | 225° F. |

Perforated Interval

| Depth MEASURED | Depth TRUE VERTICAL | Shots per foot | Perf Diameter (in) | Total Perfs |
|---|---|---|---|---|
| 9,935–11,035 | 9,690–9,693 | 50 | 1.00 | 150 |

| | |
|---|---|
| Total Number of Perforations | 150 |
| Total Feet Perforated | 1,100 ft. |

| Tubular Geometry | | | | Top | Bottom |
|---|---|---|---|---|---|
| Open Hole | 4½" OD | | | 9,935 | 11,035 |
| Tubing | 2⅞" OD | (2,441" ID) | 6.5# | 0 | 9,000 |
| Tubing | 2⅜" OD | (1.995" ID) | 4.6# | 9,000 | 11,035 |
| Casing | 5½" OD | (4.892" ID) | 17# | 0 | 9,935 |

| | |
|---|---|
| End of Tubing | 11,035 ft. |
| Pump Via | Tubing |

TABLE 12

FLUID SPECIFICATIONS

Flush: 8.7 ppg Brine Pad/Flush 35,000 Gallons

Components:

| | | |
|---|---|---|
| 2 gpt. | Acigel | Gelling Agent |
| 1 gpt. | NE-118 | Non-Emulsifier |

Acid Frac: 15% Gelled Acid 60,000 Gallons

Components:

| | | |
|---|---|---|
| 10 gpt. | Acigel | Gelling Agent |
| 5 gpt. | CI-25 | Corrosion Inhibitor |
| 5 gpt. | Ferrotrol-800LIron | Control Product |
| 2 gpt. | FAW-21 | Foaming Agent |
| 2 gpt. | NE-13 | Non-Emulsifier |

Solvent: Xylene 2,700 Gallons

Components:

| | | |
|---|---|---|
| 12 gals | NE-110 | Non-Emulsifier |

TABLE 13

| | STP | Annulus | Stage | Total | | |
|---|---|---|---|---|---|---|
| 23:40 | 0 | 4400 | | 0 | | Pressure test Annulus |
| 23:41 | 0 | 0 | 0 | 0 | 6.2 | Start Divert X down Annulus |
| 23:47 | 0 | 721 | 36 | 0 | 3.3 | Catch fluid |
| 0:20 | 0 | 350 | 102 | 36 | 0 | shut down divert @ eot |
| 2:05 | 4973 | 0 | 0 | 138 | 0 | test lines |
| 2:12 | 0 | 0 | 0 | 138 | 2.45 | start acid down tubing |
| 2:16 | 983 | 0 | 7 | 138 | 2.43 | Catch fluid |
| 2:29 | 0 | 0 | 39 | 145 | 6 | shut down acid start divert down annulus |
| 2:52 | 0 | 1450 | 40 | 184 | 4 | shut down annulus start acid down tubing |
| 2:58 | 2715 | 789 | 15 | 224 | 7 | increase rate |
| 3:08 | 0 | 680 | 61 | 239 | 0 | shut down move uphole to 10920 |
| 3:37 | 0 | 0 | 0 | 300 | 3.4 | Start Divert X down Annulus |
| 3:44 | 0 | 670 | 20 | 300 | 6.8 | shut down annulus start down tub. With acid |
| 3:45 | 2715 | 653 | 12 | 320 | 0 | shut down leak on |
| 3:48 | 2686 | 643 | 0 | 332 | 6.89 | resume pumping |
| 3:53 | 2891 | 643 | 40 | 332 | 6.91 | rate & psi |
| 3:54 | 2920 | 653 | 8 | 372 | 7.23 | slight break in psi |
| 3:59 | 2803 | 633 | 67 | 380 | 0 | shut down |
| 4:15 | 0 | 360 | 0 | 447 | 3.1 | Start Divert X down Annulus |
| 4:27 | 10 | 600 | 36 | 447 | 7.4 | start acid down tubing @ 10800 |
| 4:33 | 2850 | 546 | 37 | 483 | 7.04 | slow steady psi increase |
| 4:34 | 2965 | 536 | 12 | 520 | 8 | drop in psi |
| 4:39 | 2813 | 507 | 26 | 532 | 0 | shut down pooh |
| 4:55 | 0 | 448 | 0 | 558 | 2.5 | startdown annulus |
| 5:04 | 0 | 1023 | 25 | 558 | 6.82 | shut down on annulus start acid down tubing |
| 5:06 | 2929 | 536 | 11 | 583 | 6.66 | rate & psi |
| 5:11 | 3045 | 391 | 32 | 594 | 5.42 | decrease rate tubing sticking |
| 5:21 | 2180 | 0 | 50 | 626 | 5.33 | rate & psi |
| 5:33 | 2229 | −10 | 57 | 676 | 0 | shut down pooh to 10,500 |
| 5:59 | 10 | 127 | 0 | 733 | 2.2 | startdown annulus |
| 6:03 | 10 | 1374 | 9 | 733 | 0 | tubing stuck shut down |
| 9:25 | 0 | 0 | 0 | 742 | 1.6 | start oil down tubing |
| 9:38 | 1450 | −29 | 27 | 742 | 3 | steady psi increase |
| 9:51 | 1898 | −19 | 39 | 769 | 0 | shut down oil @ EOT |
| 9:57 | 845 | −19 | 0 | 808 | 1.5 | Begin again with pumping oil |
| 10:00 | 1205 | −10 | 4 | 808 | 0 | shut down |
| 10:05 | 835 | 0 | 0 | 812 | 1.5 | resume pumping oil |
| 10:14 | 1703 | 0 | 10 | 812 | 0 | shut down |
| 10:24 | 624 | 0 | 0 | 822 | 1.5 | resume pumping oil |
| 10:36 | 1839 | 0 | 20 | 822 | 0 | shut down |
| 10:48 | 0 | 0 | 0 | 842 | 1.4 | resume pumping oil |
| 11:31 | 1246 | 0 | 41 | 842 | 0 | shut down |
| 12:00 | 691 | 0 | 0 | 883 | 1.5 | pump water |
| 12:03 | 681 | 0 | 3 | 883 | 0 | shut down, rig off wallhead try to pooh |
| 13:30 | 0 | 0 | 0 | 886 | 0 | released go to motel Wait on call |
| 14:53 | 779 | 0 | 0 | 885 | 1.8 | pump 10 bbls water down tubing |
| 15:01 | 1217 | 0 | 10 | 886 | 1.7 | shut down |

TABLE 14

| Procedure: Threaded Tubing |
|---|
| 1) Install Fluid Control valve on bottom of tubing |
| 2) RIH with 2 ⅜ Tubing to TD, Bottom 1500' should be flush joint tubing |
| 3) Circulate 198 bbl gel containing 0.2 ppg Divert X down tubing |
| 4) POH to 9600' |
| 5) Drop bar to set fluid control valve |
| 6) Install float |
| 7) Circulate 36 bbl 15% gelled acid down tubing to fill tubing |
| 8) RIH to 10990' |
| 9) Close BOP |
| 10) Pump gel containing ½ ppg Divert X down annulus until pressure indicates diversion |
| 11) Squeeze 30 gals Acid @ 0.5 bpm<br>Note: Squeeze 75 gals Acid in Intervals above 10100 feet |
| 12) Open BOP (Allow annular pressure to decline below 1500 psi before opening BOP) |
| 13) Pull tubing 30 feet |
| 14) Close BOP |
| 15) Pump 1500 gals of Acid into formation at 3 bpm (50 gal/foot) |
| 16) Pump 1.0 bbl water |
| 17) Bleed off tubing pressure |

TABLE 14-continued

| Procedure: Threaded Tubing |
|---|
| 18) Open BOP (Allow annular pressure to decline below 1500 psi before opening BOP) |
| 19) Pull tubing to next interval |
| 20) Pump gel containing ½ ppg Divert X down annulus until pressure indicates diversion |
| 21) Circulate 20 gals acid |
| 22) Repeat steps 11 to 21 after pulling tubing to the following intervals: 10910, 10730, 10540, 10410, 10320, 10290, 10150 |
| 23) Repeat steps 11 to 21 Squeezing 75 gal of Acid after pulling tubing to the following intervals:<br>10110, 10050, 9950, 9910, 9760, 9700 |
| Note: A total of 22000 gal (524 bbl) of acid should be pumped down tubing. Acid in tubing should then be displaced with lease crude |
| 24) Open annulus through choke and flow back until pressure bleeds off |
| 25) Fish standing valve |
| 26) Circulate well with 250 bbls lease crude to remove Divert X in casing annulus |
| 27) Run tubing to TD |
| 28) Circulate 2300 gallons of Xylene containing 5 gpt NE-110 across open hole |
| 29) Pull tubing to 8000' |

TABLE 14-continued

| Procedure: Threaded Tubing |
|---|
| 30) Close BOP |
| 31) Pump 25 bbl lease crude down tubing squeezing Xylene into fractures |
| 32) Allow 24 hrs before swabbing to dissolve Divert X |

Example 9

Treatment Using Analysis Algorithm

In this example a well was treated having the following wellbore characteristics:

| | | | | | | | | |
|---|---|---|---|---|---|---|---|---|
| Well Type → | OIL | Depth (TD) | | 9654' | Depth BP | 9504' | Formation | BLUELL |
| Tubing Size → | 2⅞" | WT. | 6.5 | Set at: | 9500' | | | |
| Casing Size → | 5½" | WT. | 17# | From | SURF. | To | 9935' | |
| Open Hole → | Size | 4.5" | From | 9935' | To | 10,650' | | |

The following wellbore capacities existed (barrels):

| | |
|---|---|
| Tubing Cap. → | 60 |
| Annular Cap. → | 145 |
| Pad Volume → | 210 |
| Treating Fluid → | 833 |
| Flush → | 185 |
| Overflush → | 10 |
| Fluid to Recover → | 1247 |

Treatment fluids employed were:

| |
|---|
| 35,000 GAL 15% HCL ACID, + 10 GPT ACI-GEL, + 5 GPT CI-25, + 5 GPT F-800L, 2 GPT NE-13, + 2 GPT FAW-21 PUMP 1600 GA. XYLENE + 12 GAL NE-110W |

In this example, four intervals were stimulated. As may be seen from the procedure below, the pressure analysis algorithm of FIG. 3 indicated that the 10,650' interval broke down in the annulus (bottom hole treating pressure greater than model prediction), but was replugged by pumping additional divertor. The intervals at 10,450' and 9890' treated as predicted by model prediction. Initial BHTP when treating the interval 10,050' was less than model prediction (indicating failure to plug intervals down-hole). Additional divertor was pumped and the interval successfully stimulated. Procedure employed was as follows:

| TIME (AM) | TBG PRESS (PSI) | ANNULAR PRESS (PSI) | BBLS PUMPED IN STAGE | TOTAL BBLS PUMPED | RATE (BPM) | | **ALGORITHM BLOCK USED |
|---|---|---|---|---|---|---|---|
| 8:18 | 4976 | 0 | 0 | 0 | 0 | PRESSURE TEST | |
| 8:21 | 0 | 0 | 0 | 0 | 3.5 | START PUMPING DIVERT DOWN ANNULUS | |
| 8:23 | 243 | 0 | 6 | 0 | 1.7 | CATCH FLUID | |
| 8:24 | 2230 | 2112 | 6 | 6 | 0 | SHUT DOWN | |
| 9:26 | 40 | 40 | 0 | 12 | 3 | START DIVERT DOWN TUBING | |
| 9:29 | 900 | 110 | 10 | 12 | 3 | Start acid @ 10650' | |
| 9:47 | 0 | 166 | 60 | 22 | 1.1 | ACID @ EOT SHUT IN ANNULUS | |
| 9:52 | 856 | 1383 | 5 | 82 | 3 | INCREASE IN PSI | 100 |
| 9:55 | 1895 | 1520 | 15 | 87 | 6.89 | INCREASE IN PSI, (PRESSURE GREATER THAN MODELED) | 120 |
| 10:04 | 1924 | 1481 | 60 | 102 | 7.05 | RATE & PSI (INCREASE IN RECIPROCATION PRESSURE) | 130 |
| 10:10 | 1943 | 1500 | 40 | 162 | 7.05 | PUMP DOWN ANNULUS TO RE-ESTABLISH DIVERSION | 140 |
| 10:12 | 2060 | 1560 | 30 | 202 | 7.03 | START ACID | 150 |
| 10:16 | 2119 | 1491 | 20 | 232 | 7 | START FLUSH | 170 |
| 10:18 | 0 | 1413 | 10 | 252 | 0 | SHUT DOWN MOVE TUBING TO 10450' | |
| 10:34 | 515 | 692 | 0 | 262 | 2.84 | START ACID @ 10450' | |
| 10:46 | 408 | 1003 | 30 | 262 | 0 | SHUT DOWN ACID @ EOT PUMP DOWN ANNULUS | |
| 10:53 | 29 | 1140 | 10 | 292 | 3 | SHUT DOWN ANNULUS START ACID DOWN TUBING | 100 |
| 10:56 | 1613 | 1081 | 4 | 302 | 7.03 | RATE & PSI | 110 |
| 11:01 | 1846 | 1403 | 40 | 306 | 7.09 | BREAK IN PSI ON TUBING (BROKE @ 2316 PSI) | 170 |

-continued

| TIME (AM) | TBG PRESS (PSI) | ANNULAR PRESS (PSI) | BBLS PUMPED IN STAGE | TOTAL BBLS PUMPED | RATE (BPM) | | **ALGORITHM BLOCK USED |
|---|---|---|---|---|---|---|---|
| 11:09 | 1953 | 1481 | 56 | 346 | 7.07 | PUMP DOWN ANNULUS | |
| 11:18 | 2218 | 1491 | 60 | 402 | 0 | SHUT DOWN PUMPED 50 DIVERT AND 10 WATER | |
| 11:40 | 39 | 653 | 0 | 462 | 1.6 | START ACID DOWN TUBING @ 10050' | |
| 12:04 | 593 | 877 | 46 | 462 | 2.7 | INCREASE RATE | |
| 12:09 | 719 | 994 | 14 | 508 | 3.17 | ACID @ EOT | |
| 12:11 | 1254 | 1062 | 5 | 522 | 7.13 | INCREASE RATE | 100 |
| 12:15 | 1569 | 1325 | 30 | 527 | 7.08 | SLOW STEADY INCREASE IN PSI ON BOTH SIDES | |
| 12:31 | 1630 | 1371 | 105 | 557 | 7.03 | Psi & rate (BHTP LESS THAN MODEL) stable | 180, 190 |
| 12:48 | 1730 | 1471 | 130 | 662 | 7.02 | START DIVERT | 200 |
| 12:54 | 1798 | 1452 | 40 | 792 | 6.57 | RESUME ACID | 200 |
| 12:57 | 1885 | 1442 | 10 | 832 | 0 | SHUT DOWN | |
| | | | | 842 | | POOH TO 9890' | |
| 13:10 | 0 | 1003 | 0 | 842 | 3 | START DIVERT (DIVERT @ EOT) | |
| 13:29 | 962 | 1091 | 52 | 842 | 3 | START ACID DOWN TUBING @ 9890' | 100 |
| 13:37 | 1137 | 1169 | 23 | 894 | 3.5 | RATE & PSI | |
| 13:39 | 1147 | 1198 | 9 | 917 | 4 | INCREASE RATE | |
| 13:44 | 1301 | 1325 | 19 | 926 | 4.34 | RATE & PSI | 110 |
| 13:51 | 1295 | 1354 | 30 | 945 | 3.98 | DECREASE RATE | |
| 14:01 | 1205 | 1335 | 45 | 975 | 3.97 | RATE & PSI | |
| 14:16 | 1137 | 1315 | 61 | 1020 | 3.35 | START CRUDE | |
| 14:30 | 1759 | 1305 | 45 | 1081 | 2.79 | START WATER | |
| 14:33 | 1837 | 1296 | 5 | 1126 | 0 | SHUT DOWN (RIH TO 10650') | 170 |
| 15:21 | 39 | 750 | 0 | 1131 | 1 | PUMP DOWN ANNULUS WITH OIL | |
| 15:34 | 39 | 896 | 15 | 1131 | 1.2 | START WATER | |
| 15:39 | 39 | 896 | 5 | 1146 | 0 | SHUT DOWN | |
| 16:30 | 58 | 156 | 0 | 1151 | 4.5 | SPOT XYLENE DOWN TUBING | |
| 16:48 | 1127 | 146 | 40 | 1151 | 2.52 | START OIL | |
| 16:57 | 1331 | 302 | 21 | 1191 | 2.89 | XYLENE @ EOT | |
| 17:00 | 1283 | 380 | 16 | 1212 | 2.57 | START WATER | |
| 17:11 | 1302 | 546 | 19 | 1228 | 0 | SHUT DOWN XYLENE ON SPOT | |
| | | | | | | PUMPED A TOTAL OF 842 BBL ACID, 429 BBL WATER AND DIVERT, AND 81 BBL OF OIL | |
| | | | | | | TOTAL DIVERT PUMPED WAS 210 BBL. @ 0.75 PPG | |

**Displayed number indicates analysis block of PAA of FIG. 3 that was used during treatment stage.

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed compositions and methods may be utilized in various combinations and/or independently. Thus the invention is not limited to only those combinations shown herein, but rather may include other combinations. For example, a diverting agent system volume may be displaced to the formation down the annulus, rather than a pipe string.

Furthermore non-flush joint tubing may also be employed.

What is claimed is:

1. A method of treating a wellbore penetrating a subterranean formation and having an inner pipe suspended within said wellbore, comprising:

(A) introducing diverting agent into said pipe and displacing a volume of said diverting agent through said pipe into an annulus existing between said pipe and said wellbore to a depth adjacent or above said subterranean formation;

(B) introducing a fluid into said annulus and displacing at least a portion of said diverting agent volume present in said annulus into said subterranean formation; and (C) introducing a well treatment fluid into said pipe and displacing said well treatment fluid through said pipe to treat said subterranean formation;

(D) measuring a treating pressure value, said measured treating pressure value being based on a surface treating pressure of said annulus or said pipe during said introducing of said well treatment fluid and comprising said measured surface treating pressure or a value calculated based on said measured surface treating pressure;

(E) comparing said measured treating pressure value with a target treating pressure value; and based on said comparison of step (E) performing one of following steps (F), (G) or (H) prior to completing said treating of said wellbore by introduction of said well treatment fluid into said pipe:

(F) if said measured treating pressure value of step (D) is less than said respective target treating pressure value, then ceasing introduction of said well treatment fluid into said pipe, displacing an additional portion of said diverting agent volume present in said annulus into said subterranean formation, and then reestablishing introduction of said well treatment fluid into said pipe and displacing said well treatment fluid through said pipe to treat said subterranean formation;

(G) if said measured treating pressure value of step (D) is the same as said target treating pressure value, then continuing said introduction of said well treatment fluid into said pipe;

(H) if said measured treating pressure value of step (D) is greater than said target treating pressure value, then raising said pipe and measuring the force or weight required to raise said pipe during said introduction of said well treatment fluid and comparing said measured force or weight to raise said pipe with a calculated or measured target weight or force required to raise said pipe in the absence of introduction of fluid into said pipe; and based on said comparison of step (H) performing one of following steps (I) or (J) as follows:

(I) if said measured force or weight of step (H) required to raise said pipe during said introduction of said well treatment fluid is more than said target weight or force required to raise said pipe, then ceasing introduction of said well treatment fluid into said pipe, displacing an additional portion of said diverting agent volume present in said annulus into said subterranean formation, and then reestablishing introduction of said well treatment fluid into said pipe and displacing said well treatment fluid through said pipe to treat said subterranean formation;

(J) if said measured force or weight of step (H) required to raise said pipe during said introduction of said well treatment fluid is the same as said target weight or force required to raise said pipe, then continuing said introduction of said well treatment fluid into said pipe.

2. The method of claim 1, wherein after the performance of step (H), further comprising:

K) raising said pipe and measuring the force or weight required to raise said pipe a second time during said introduction of said well treatment fluid and comparing said measured force or weight to raise said pipe with a calculated or measured target weight or force required to raise said pipe in the absence of introduction of fluid into said pipe; and based on said comparison of step (K) performing one of following steps (L) or (M) prior to completing said treating of said wellbore:

(L) if said measured force or weight of step (K) required to raise said pipe a second time during said introduction of said well treatment fluid is more than said target weight or force required to raise said pipe, then ceasing introduction of said well treatment fluid into said pipe, raising an end of said pipe above a depth of suspected formation break down in said wellbore, and reestablishing introduction of said well treatment fluid into said pipe;

(M) if said force or weight required to raise said pipe during said introduction of said well treatment fluid is the same as said target weight or force required to raise said pipe, then continuing said introduction of said well treatment fluid into said pipe.

3. The method of claim 1, further comprising introducing a clean-up fluid into said subterranean formation to remove said diverting agent from said subterranean formation.

4. The method of claim 1, wherein said subterranean formation has a formation top and a formation bottom, and wherein said well treatment fluid is displaced through said pipe into said annulus at a depth adjacent or below said bottom of said subterranean formation.

5. The method of claim 1, wherein said subterranean formation is located in an open-hole portion of said wellbore.

6. The method of claim 5, wherein said open-hole portion of said wellbore is highly deviated or horizontal.

7. The method of claim 6, wherein said well treatment is introduced into said subterranean formation at a pressure above a fracturing pressure of said formation.

8. A method of treating a wellbore penetrating a subterranean formation and having an inner pipe suspended within said wellbore, comprising:

(A) introducing diverting agent into said pipe and displacing a volume of said diverting agent through said pipe into an annulus existing between said pipe and said wellbore to a depth adjacent or above said subterranean formation;

(B) introducing a fluid into said annulus and displacing at least a portion of said diverting agent volume present in said annulus into said subterranean formation; and (C) introducing a well treatment fluid into said pipe and displacing said well treatment fluid through said pipe to treat said subterranean formation;

(D) measuring a treating pressure value, said measured treating pressure value being based on a surface treating pressure of said annulus or said pipe during said introducing of said well treatment fluid and comprising said measured surface treating pressure or a value calculated based on said measured surface treating pressure; and comparing said measured treating pressure value with a target treating pressure value; and/or measuring the force or weight required to raise said pipe during said introduction of said well treatment fluid and comparing said measured force or weight to raise said pipe with a calculated or measured target weight or force required to raise said pipe in the absence of introduction of fluid into said pipe; and performing one of following steps (E), (F) or (G) based on at least one of said comparisons prior to completing said treating of said wellbore by introduction of said well treatment fluid into said pipe:

(E) ceasing introduction of said well treatment fluid into said pipe, displacing an additional portion of said diverting agent volume present in said annulus into said subterranean formation, and then reestablishing introduction of said well treatment fluid into said pipe and displacing said well treatment fluid through said pipe to treat said subterranean formation;

(F) raising an end of said pipe above a depth of suspected formation break down in said wellbore, and reestablishing introduction of said well treatment fluid into said pipe;

(G) continuing said introduction of said well treatment fluid into said pipe.

9. A method of treating at least two identified intervals of a subterranean formation penetrated by a highly deviated or horizontal wellbore having an inner pipe suspended within said wellbore, comprising:

positioning an end of said pipe to a depth below a first identified interval of said subterranean formation, said first interval being the identified interval located farthest from the surface;

introducing diverting agent into said pipe and displacing a volume of said diverting agent through said pipe into an annulus existing between said pipe and said wellbore to a depth adjacent or above said first interval of said subterranean formation;

introducing a fluid into said annulus and displacing at least a portion of said diverting agent volume present in said annulus into said subterranean formation;

introducing a well treatment fluid into said pipe and displacing said well treatment fluid through said pipe to treat said first interval of said subterranean formation;

repositioning said end of said pipe within said wellbore to a depth adjacent or above at least a second identified interval of said subterranean formation, said second interval being located between said first interval and said surface;

introducing a fluid into said annulus and displacing at least a portion of said diverting agent volume present in said annulus into said subterranean formation;

introducing a well treatment fluid into said pipe and displacing said well treatment fluid through said pipe to treat said second interval of said subterranean formation; and introducing a clean-up fluid into said subterranean formation to remove said diverting agent from said subterranean formation; and further comprising:

(A) measuring a treating pressure value, said measured treating pressure value being based on a surface treating pressure of said annulus or said pipe during said introducing of said well treatment fluid, and comprising said measured surface treating pressure or a value calculated based on said measured surface treating pressure;

(B) comparing said measured treating pressure value with a target treating pressure value range; and based on said comparison of step (B) performing one of following steps (C), D) or (E) prior to completing said treating by introducing said well treatment fluid into said pipe:

(C) if said measured treating pressure value of step (A) is less than said target treating pressure value range, then ceasing introduction of said well treatment fluid into said pipe, displacing an additional portion of said diverting agent volume present in said annulus into said subterranean formation, and then reestablishing introduction of said well treatment fluid into said pipe and displacing said well treatment fluid through said pipe to treat said subterranean formation;

(D) if said measured treating pressure value of step (A) is within said target treating pressure value range, then continuing said introduction of said well treatment fluid into said pipe;

(E) if said measured treating pressure value of step A is greater than said target treating pressure value range, then raising said pipe and measuring the force or weight required to raise said pipe during said introduction of said well treatment fluid and comparing said measured force or weight to raise said pipe with a target weight or target force based on the force required to raise said pipe in the absence of introduction of fluid into said pipe; and based on said comparison of step (E) performing one of following steps (F) or (G) as follows:

(F) if said force or weight required to raise said pipe during said introduction of said well treatment fluid is more than said target weight or target force, then ceasing introduction of said well treatment fluid into said pipe, displacing an additional portion of said diverting agent volume present in said annulus into said subterranean formation, and then reestablishing introduction of said well treatment fluid into said pipe and displacing said well treatment fluid through said pipe to treat said subterranean formation;

(G) if said force or weight required to raise said pipe during said introduction of said well treatment fluid is not more than said target weight or target force, then continuing said introduction of said well treatment fluid into said pipe.

10. The method of claim 9, wherein said target treating pressure value range is equal to from about 5% less than to about 5% greater than a calculated target treating pressure value calculated based on wellbore, formation and treatment fluid parameters.

11. The method of claim 9, wherein said target treating pressure value range is equal to from about 5% less than to about 5% greater than a calculated target treating pressure value calculated based on wellbore, formation and treatment fluid parameters; and wherein the upper end of said target weight or target force is equal to about 10% greater than a calculated or measured value of weight or force required to raise said pipe in the absence of introduction of fluid into said pipe.

12. The method of claim 9, wherein after performance of step (E), further comprising:

(H) raising said pipe and measuring the force or weight required to raise said pipe during said introduction of said well treatment fluid and comparing said measured force or weight to raise said pipe with a target weight or target force based on the force required to raise said pipe in the absence of introduction of fluid into said pipe; and based on said comparison of step (H) performing one of following steps (I) or (J):

(I) if said measured force or weight of step (H) required to raise said pipe during said introduction of said well treatment fluid is more than said target weight or target force, then ceasing introduction of said well treatment fluid into said pipe, raising an end of said pipe above a depth of suspected formation break down in said wellbore, and reestablishing introduction of said well treatment fluid into said pipe;

(J) if said measured force or weight of step (H) required to raise said pipe during said introduction of said well treatment fluid is within said target weight or target force, then continuing said introduction of said well treatment fluid into said pipe.

13. The method of claim 12, wherein said well treatment is introduced into said subterranean formation at a pressure above a fracturing pressure of said formation.

14. The method of claim 12, wherein said target treating pressure value range is equal to from about 5% less than to about 5% greater than a calculated target treating pressure value calculated based on wellbore, formation and treatment fluid parameters; and wherein the highest value of said target weight or target force is equal to about 10% greater than a calculated or measured value of weight or force required to raise said pipe in the absence of introduction of said well treatment fluid into said pipe.

15. The method of claim 12, wherein said subterranean formation is located in an open-hole portion of said wellbore.

16. The method of claim 15, wherein a volume of diverting agent sufficient to fill said annulus across an interval exposed to said subterranean formation is introduced into said annulus.

17. The method of claim 15, wherein a volume of diverting agent introduced into said annulus is greater than a volume sufficient to fill said annulus across an interval exposed to said subterranean formation with an additional reserve volume.

* * * * *